US007938501B2

(12) United States Patent
Takamiya et al.

(10) Patent No.: US 7,938,501 B2
(45) Date of Patent: May 10, 2011

(54) INK JET PRINTING APPARATUS AND INK JET PRINTING METHOD

(75) Inventors: Hideaki Takamiya, Kawasaki (JP); Hitoshi Nishikori, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/700,805

(22) Filed: Feb. 5, 2010

(65) Prior Publication Data

US 2010/0134544 A1 Jun. 3, 2010

Related U.S. Application Data

(62) Division of application No. 11/693,403, filed on Mar. 29, 2007, now Pat. No. 7,686,413.

(30) Foreign Application Priority Data

Apr. 10, 2006 (JP) ..... 2006-108068

(51) Int. Cl.
*B41J 29/38* (2006.01)

(52) U.S. Cl. ..... 347/17; 347/11; 347/14

(58) Field of Classification Search ..... 347/5, 9, 347/14, 17, 19, 10, 11
See application file for complete search history.

(56) References Cited

U.S. PATENT DOCUMENTS

| | | | | |
|---|---|---|---|---|
| 5,861,895 | A | 1/1999 | Tajika et al. | |
| 5,880,751 | A | 3/1999 | Nishikori et al. | |
| 5,894,314 | A | 4/1999 | Tajika et al. | |
| 6,086,180 | A | 7/2000 | Sugimoto et al. | 347/14 |
| 6,116,710 | A | 9/2000 | Tajika et al. | |
| 6,302,509 | B1 | 10/2001 | Iwasaki et al. | |
| 6,439,696 | B1 | 8/2002 | Murakami et al. | |
| 6,457,794 | B1 | 10/2002 | Tajika et al. | |
| 6,652,057 | B2 | 11/2003 | Masuda et al. | |
| 6,663,217 | B2 | 12/2003 | Otsuka et al. | |
| 6,769,755 | B2 | 8/2004 | Mizutani et al. | 347/14 |
| 7,686,413 | B2 * | 3/2010 | Takamiya et al. | 347/14 |
| 2007/0057984 | A1 | 3/2007 | Takamiya et al. | 347/10 |
| 2007/0236523 | A1 | 10/2007 | Nishikori et al. | |

FOREIGN PATENT DOCUMENTS

| | | |
|---|---|---|
| EP | 0 750 988 | 1/1997 |
| JP | 5-31905 | 2/1993 |
| JP | 5-220963 | 8/1993 |
| JP | 6-336023 | 12/1994 |
| JP | 7-052388 | 2/1995 |
| JP | 7-323552 | 12/1995 |
| JP | 2001-180015 | 7/2001 |
| JP | 2002-103637 | 4/2002 |
| JP | 2003-211671 | 7/2003 |
| JP | 2004-1435 | 1/2004 |

* cited by examiner

*Primary Examiner* — Lam S Nguyen
(74) *Attorney, Agent, or Firm* — Fitzpatrick, Cella, Harper & Scinto

(57) ABSTRACT

A voltage pulse that keeps the ejection volume within a specified range is selected for a plurality of print element columns, based on the heater rank and ink temperature information that influences the ejection volume during ink ejection. At this time, the voltage pulse is controlled so that the voltage value of the pulse is equal for a plurality of print element columns at any ink temperature and varies according to the ink temperature. This control process enables pulses of the same voltage value to be applied at all times to a plurality of nozzle columns even if these nozzle columns in the print head have different heater ranks. As a result, the ejection volumes of all nozzle columns can be kept within a specified range with high precision over a wide range of base temperature, without requiring complicated circuit configurations.

7 Claims, 24 Drawing Sheets

| | | TEMPERATURE RANK | | | | | | | | | | | | | | |
|---|---|---|---|---|---|---|---|---|---|---|---|---|---|---|---|---|
| | | 20°C | | | 30°C | | | 40°C | | | 50°C | | | ... | | |
| | | P1(μs) | P3(μs) | $V_H$(V) | P1(μs) | P3(μs) | $V_H$(V) | P1(μs) | P3(μs) | $V_H$(V) | P1(μs) | P3(μs) | $V_H$(V) | P1(μs) | P3(μs) | $V_H$(V) |
| HEATER RANK | RANK Min | 0.30 | 0.30 | 20.0 | 0.30 | 0.40 | 20.0 | 0.10 | 0.50 | 20.0 | 0.00 | 0.60 | 20.0 | 0.00 | 0.50 | 22.0 |
| | • | • | • | • | • | • | • | • | • | • | • | • | • | • | • | • |
| | • | • | • | • | • | • | • | • | • | • | • | • | • | • | • | • |
| | • | • | • | • | • | • | • | • | • | • | • | • | • | • | • | • |
| | • | • | • | • | • | • | • | • | • | • | • | • | • | • | • | • |
| | RANK CENTER | 0.20 | 0.50 | 20.0 | 0.10 | 0.60 | 20.0 | 0.00 | 0.70 | 20.0 | 0.00 | 0.60 | 22.0 | 0.00 | 0.50 | 24.0 |
| | • | • | • | • | • | • | • | • | • | • | • | • | • | • | • | • |
| | • | • | • | • | • | • | • | • | • | • | • | • | • | • | • | • |
| | • | • | • | • | • | • | • | • | • | • | • | • | • | • | • | • |
| | • | • | • | • | • | • | • | • | • | • | • | • | • | • | • | • |
| | RANK Max | 0.10 | 0.70 | 20.0 | 0.00 | 0.80 | 20.0 | 0.00 | 0.70 | 22.0 | 0.00 | 0.60 | 24.0 | 0.00 | 0.40 | 26.0 |

| | | TEMPERATURE RANK | | | | | | | | | | | | | | |
|---|---|---|---|---|---|---|---|---|---|---|---|---|---|---|---|---|
| | | 20°C | | | 30°C | | | 40°C | | | 50°C | | | ... | | |
| | | P1(μs) | P3(μs) | $V_H$(V) | P1(μs) | P3(μs) | $V_H$(V) | P1(μs) | P3(μs) | $V_H$(V) | P1(μs) | P3(μs) | $V_H$(V) | P1(μs) | P3(μs) | $V_H$(V) |
| HEATER RANK | RANK Min | 0.30 | 0.30 | 20.0 | 0.30 | 0.40 | 20.0 | 0.10 | 0.50 | 20.0 | 0.00 | 0.60 | 20.0 | 0.00 | 0.50 | 22.0 |
| | • | • | • | • | • | • | • | • | • | • | • | • | • | • | • | • |
| | • | • | • | • | • | • | • | • | • | • | • | • | • | • | • | • |
| | • | • | • | • | • | • | • | • | • | • | • | • | • | • | • | • |
| | • | • | • | • | • | • | • | • | • | • | • | • | • | • | • | • |
| | RANK CENTER | 0.20 | 0.50 | 20.0 | 0.10 | 0.60 | 20.0 | 0.00 | 0.70 | 20.0 | 0.00 | 0.60 | 22.0 | 0.00 | 0.50 | 24.0 |
| | • | • | • | • | • | • | • | • | • | • | • | • | • | • | • | • |
| | • | • | • | • | • | • | • | • | • | • | • | • | • | • | • | • |
| | • | • | • | • | • | • | • | • | • | • | • | • | • | • | • | • |
| | • | • | • | • | • | • | • | • | • | • | • | • | • | • | • | • |
| | RANK Max | 0.10 | 0.70 | 20.0 | 0.00 | 0.80 | 20.0 | 0.00 | 0.70 | 22.0 | 0.00 | 0.60 | 24.0 | 0.00 | 0.40 | 26.0 |

FIG.23

| | | TEMPERATURE RANK | | | | | | | | | | | | | | |
|---|---|---|---|---|---|---|---|---|---|---|---|---|---|---|---|---|
| | | 20°C | | | 30°C | | | 40°C | | | 50°C | | | ... | | |
| | | P1(μs) | P3(μs) | $V_H$(V) | P1(μs) | P3(μs) | $V_H$(V) | P1(μs) | P3(μs) | $V_H$(V) | P1(μs) | P3(μs) | $V_H$(V) | P1(μs) | P3(μs) | $V_H$(V) |
| HEATER RANK | RANK Min | 0.30 | 0.30 | 20.0 | 0.20 | 0.40 | 20.0 | 0.05 | 0.50 | 22.0 | 0.00 | 0.45 | 24.0 | 0.00 | 0.30 | 26.0 |
| | • | • | • | • | • | • | • | • | • | • | • | • | • | • | • | • |
| | • | • | • | • | • | • | • | • | • | • | • | • | • | • | • | • |
| | • | • | • | • | • | • | • | • | • | • | • | • | • | • | • | • |
| | • | • | • | • | • | • | • | • | • | • | • | • | • | • | • | • |
| | RANK CENTER | 0.20 | 0.50 | 20.0 | 0.10 | 0.60 | 20.0 | 0.00 | 0.61 | 22.0 | 0.00 | 0.53 | 24.0 | 0.00 | 0.35 | 26.0 |
| | • | • | • | • | • | • | • | • | • | • | • | • | • | • | • | • |
| | • | • | • | • | • | • | • | • | • | • | • | • | • | • | • | • |
| | • | • | • | • | • | • | • | • | • | • | • | • | • | • | • | • |
| | • | • | • | • | • | • | • | • | • | • | • | • | • | • | • | • |
| | RANK Max | 0.10 | 0.70 | 20.0 | 0.00 | 0.80 | 20.0 | 0.00 | 0.70 | 22.0 | 0.00 | 0.60 | 24.0 | 0.00 | 0.40 | 26.0 |

FIG.24

INK JET PRINTING APPARATUS AND INK JET PRINTING METHOD

This is a division of U.S. patent application Ser. No. 11/693,403, filed Mar. 29, 2007, now U.S. Pat. No. 7,686,413, which issued on Mar. 30, 2010.

BACKGROUND OF THE INVENTION

1. Field of the Invention

The present invention relates to an ink jet printing apparatus and an ink jet printing method which prints an image on a print medium by ejecting ink onto the print medium and more particularly to a method of controlling voltage pulses applied to electrothermal transducers (heaters) for ejecting ink.

2. Description of the Related Art

The ink jet printing apparatus forms an image by ejecting ink from print elements in response to an image signal to print a plurality of dots on a print medium. Such an ink jet printing system has many advantages over other printing systems, including high speed, high density printing, a color printing capability with a simple construction and a quietness during printing.

A construction that ejects ink from print elements has already been proposed and implemented in some types of printing apparatus, of which a type that uses electrothermal transducers (heaters) in print elements can eject small drops of ink at a high density and at a high frequency and thus has found a wide range of applications. An ink jet print head of this construction has a plurality of print elements arrayed at a density corresponding to a print resolution. Each of the print elements is provided with a liquid path to introduce ink to a nozzle opening and also an electrothermal transducer (heater) in contact with the ink in the liquid path. In ejecting ink from the print elements in response to an image signal, individual heaters are applied a predetermined voltage pulse to be energized to heat the ink. A rapid heating causes the ink in contact with the heater surface to produce a film boiling, in which an expanding bubble expels a predetermined volume of ink from the nozzle opening which flies and lands on a print medium forming a dot.

In the ink jet print head of the above construction, a volume of ink droplet ejected from individual print element (hereinafter referred to as an ejection volume) depends on a resistance of the heater installed in each print element. This is because the amount of heat produced by the heater to generate a bubble during the film boiling varies depending on the resistance of the heater. So, if, when a color image is printed by a plurality of print heads, there are variations in heater resistance among individual print heads for example, the ejection volume will differ from one print head to another, giving rise to a possibility of the image being printed showing different colors from desired ones.

Further, the ejection volume is influenced by the temperature of the print head or more directly by the temperature of ink near the heater. This is because an ink viscosity changes with an ink temperature and a volume of a bubble and its growth speed during the film boiling depend on the ink viscosity. For example, when the temperature of the print head is low, the ink viscosity increases, making a bubble volume small, with the result that the volume of ink ejected and therefore an area of a printed dot become small. Conversely, when the print head temperature is high, the ink viscosity lowers, making the bubble volume large, with the result that the volume of ink ejected and therefore the printed dot area increase. That is, even if the printing is done based on the same image data, an unstable print head temperature would make the size of dots formed on a print medium unstable, which in turn leads to unstable image density.

Further, when a color image is printed using a plurality of print heads, temperature variations among the different color print heads will likely result in a color produced differing from a desired one. Furthermore, if the temperatures of individual print heads change, the color produced will deviate unstably from target color coordinates In the print head manufacturing process, the print heads with a bubble forming heater inevitably have some variations in heater resistance. Considering the print head construction, it is also inevitable that the temperature varies among the print heads depending on the environment in which the printing apparatus is used or the frequencies of use of individual color heads. However, in the ink jet printing apparatus variations in image density and color produced are not desirable. It is therefore one of important tasks with the ink jet printing apparatus to stabilize the ejection volume of the print heads.

Japanese Patent Laid-Open No. 5-031905 (1993) discloses a technology which applies two voltage pulses for each ink ejection and controls a pulse width stepwise according to the temperature of the print head to stabilize the ejection volume of ink. This ejection volume control is referred to as a double pulse drive control.

FIG. 1 is a timing chart showing the double pulse drive control. An abscissa represents time and an ordinate represents a voltage applied to the heater. One ejection is done by two pulses shown in the figure. A control circuit in the ink jet printing apparatus sets a pulse width of a pulse signal shown in the figure according to the temperature to stabilize a volume of ejected ink droplets. In the figure, P1 represents a preheat pulse application time, P3 a main heat pulse application time, and P2 an interval between the preheat pulse and the main heat pulse.

The preheat pulse is applied to warm ink near the heater surface and its application time P1 is set so as to keep the energy applied at a level that will not result in generation of a bubble. The main heat pulse on the other hand is applied to cause a film boiling in the ink warmed by the preheat pulse and thereby execute an ejection. Its application time P3 is set larger than P1 so as to produce an enough energy to generate a bubble.

As described above, the ink ejection volume is considered as being dependent on a temperature distribution of ink near the heater. Japanese Patent Laid-Open No. 5-031905 (1993) discloses a method which adjusts the pulse width P1 of the preheat pulse according to the detected temperature to realize a stable ejection volume. More specifically, as the detected temperature gradually increases, for example, the necessity of heating the ink near the heater surface decreases progressively. The preheat pulse width P1 is therefore set to decrease progressively. Conversely, when the detected temperature gradually lowers, the necessity of warming the ink near the heater surface progressively increases and the preheat pulse width P1 is set to increase progressively.

Japanese Patent Laid-Open No. 5-031905 (1993) discloses a construction in which a table having predefined P1 related to the detected temperature is stored in memory in advance. Further, this cited document also discloses a method which classifies the print heads into a plurality of ranks according to the ejection volume (heater resistance) under the same condition and which provides tables that match the plurality of ranks. The use of the double pulse drive control described in Japanese Patent Laid-Open No. 5-031905 (1993) makes it possible to maintain the ejection volume at a fixed level stably for all colors even if the heater resistance and temperature differ from one print head to another.

In the conventional double pulse drive control such as disclosed in Japanese Patent Laid-Open No. 5-031905 (1993), an energy applied to the heater is adjusted by changing the pulse width while keeping the drive voltage constant. It should be noted, however, that the stabilization of ejection volume can also be achieved with a single pulse by changing the pulse voltage and the pulse width simultaneously. Such ejection volume control methods (hereinafter referred to as single pulse drive controls) are disclosed in Japanese Patent Laid-Open Nos. 2001-180015 and 2004-001435.

In the ink jet printing apparatus with a heater, there is a tendency that the ejection volume is larger when a lower voltage pulse is applied for a longer duration than when a higher voltage pulse is applied for a shorter duration. This is considered due to the fact that the application of a lower voltage pulse for a longer duration causes an ink area that is heated up to a bubble forming temperature to spread more widely by heat conduction, whereas applying a high voltage rapidly heats only an area very close to the heater, causing an instant generation of a bubble, resulting in a smaller ejection volume. Japanese Patent Laid-Open Nos. 2001-180015 and 2004-001435 describe an ejection control method that takes advantage of such an ejection characteristic and which, when one wishes to increase the ejection volume, reduces the drive voltage and widens (elongates) the pulse width and, when one wishes to reduce the ejection volume, raises the drive voltage and narrows (shortens) the pulse width.

As described above, the ink jet printing apparatus of recent years seek to keep the ejection volume as stable as possible by adopting the double pulse drive control method described in Japanese Patent Laid-Open No. 5-031905 (1993) and the single pulse drive control method disclosed in Japanese Patent Laid-Open Nos. 2001-180015 and 2004-001435.

Comparison between the double pulse ejection volume control and the single pulse ejection volume control shows that the double pulse drive control that adjusts the preheat pulse application time at a relatively low voltage generally has higher control reliability. However, as ink droplets are becoming smaller and smaller in recent years, it is increasingly difficult to maintain small ejection volumes stably with only the double pulse ejection volume control. For example, when the print head temperature continues to rise after continuous printing operations, the width of the preheat pulse is narrowed to reduce the ejection volume. There are, however, cases where even after the pulse width has become zero, the ejection volume remains too large.

In such cases, the target ejection volume can be maintained by switching from the double pulse drive control to the single pulse drive control when the preheat pulse width becomes zero. Then, small droplets of a predetermined volume can be expected to be ejected stably even if the temperature of the print head varies over a wide range.

However, for print heads with heaters of different resistances, the timing at which to switch from the double pulse drive control to the single pulse drive control may vary from head to head.

FIG. 2 is a schematic diagram showing how the drive control method is switched according to the heater rank (dependent on the heater resistance) of the print head and the temperature. In this specification, although the heater rank depends on the heater resistance, it is not determined by the resistance alone. Details of the heater rank will be explained later.

In the diagram, an abscissa represents a head temperature and an ordinate represents a heater rank of the print head. Normally, the print head before printing is set at around 20° C. by a room temperature or by temperature regulation. Depending on the printing operation, the temperature is expected to rise up to around 60° C. The heater rank may vary in a range from maximum to minimum.

In the double pulse drive control, as the heater rank increases, the preheat pulse width narrows early and the drive control needs to be switched to the single pulse drive control at the earliest phase (when the temperature is still low). Conversely, when the heater rank is small, the range in which the ejection volume can be adjusted by the double pulse drive control is wide so that the switching to the single pulse drive control is made at the last phase (when the temperature is high).

When a plurality of print heads or nozzle columns with different heater ranks are mounted on the same printing apparatus, different voltages may be required for different heater ranks. This will make the circuits in the apparatus complex, increasing the overall cost of the printing apparatus. This is not realistic for the ink jet printing apparatus which has a low cost as one of its features.

SUMMARY OF THE INVENTION

The present invention has been accomplished to solve the above problems. It is an object of this invention to provide an ink jet printing apparatus and method capable of dealing with a plurality of heater ranks with a single value of voltage and thereby ejecting small-volume ink droplets stably without being affected by temperature changes.

The first aspect of the present invention is an ink jet printing apparatus to form an image on a print medium by using a print head, wherein the print head has a plurality of print element columns, each composed of an array of print elements adapted to eject ink by applying a voltage pulse to a heater, the ink jet printing apparatus comprising: means for acquiring for each of the plurality of print element columns heat amount information representing the amount of heat transferred from the heater to the ink in unit time; means for acquiring an ink temperature of the print element columns; and selection means for selecting a pulse for each of the plurality of print element columns based on the heat amount information and the ink temperature; wherein the selection means selects pulses of equal voltage values for the individual print element columns irrespective of the heat amount information, whatever value the ink temperature may be, and the voltage values of the selected pulses are based on the ink temperature.

The second aspect of the present invention is an ink jet printing apparatus to form an image on a print medium by using a print head, wherein the print head has a plurality of print element columns, each composed of an array of print elements adapted to eject ink by applying a pulse to a heater, the ink jet printing apparatus comprising: first acquisition means for acquiring for each of the plurality of print element columns rank information representing the amount of heat transferred from the heater to the ink in unit time; second acquisition means for acquiring temperature information of the print head; a table to hold pulse information including width information and voltage information of the pulse corresponding to the temperature information and the rank information; selection means for selecting the pulse information from the table for each of the plurality of print element columns based on the rank information acquired by the first acquisition means and on the temperature information acquired by the second acquisition means; and drive means for driving the print elements based on the pulse information selected by the selection means; wherein the voltage information of the pulse is equal for particular temperature information regardless of the rank information and, in regions higher than a predetermined temperature, varies according to the temperature information.

The third aspect of the present invention is an ink jet printing method to form an image on a print medium by using a print head, wherein the print head has a plurality of print element columns, each composed of an array of print elements adapted to eject ink by applying a pulse to a heater, the ink jet printing method comprising: a first acquisition step to acquire for each of the plurality of print element columns rank information representing the amount of heat transferred from the heater to the ink in unit time; a second acquisition step to acquire temperature information of the print head; a selection step to select a pulse information for each of the plurality of print element columns based on the rank information acquired by the first acquisition step and on the temperature information acquired by the second acquisition step; and a drive step to drive the print elements based on the pulse information selected by the selection step; wherein the pulse information includes width information and voltage information of the pulse; wherein the selection step selects the pulse information from a table that holds the pulse information by matching it with the temperature information and the rank information; wherein the voltage information of the pulse is equal for particular temperature information regardless of the rank information and, in regions higher than a predetermined temperature, varies according to the temperature information.

Further features of the present invention will become apparent from the following description of exemplary embodiments (with reference to the attached drawings).

BRIEF DESCRIPTION OF THE DRAWINGS

FIG. 23 shows a table that provides drive pulses for different base temperatures and heater ranks; and FIG. 24 shows a pulse table applied to a first embodiment of this invention.

DESCRIPTION OF THE EMBODIMENTS

First Embodiment

1. Basic Construction 1.1 Outline of Printing System

Figure 3:
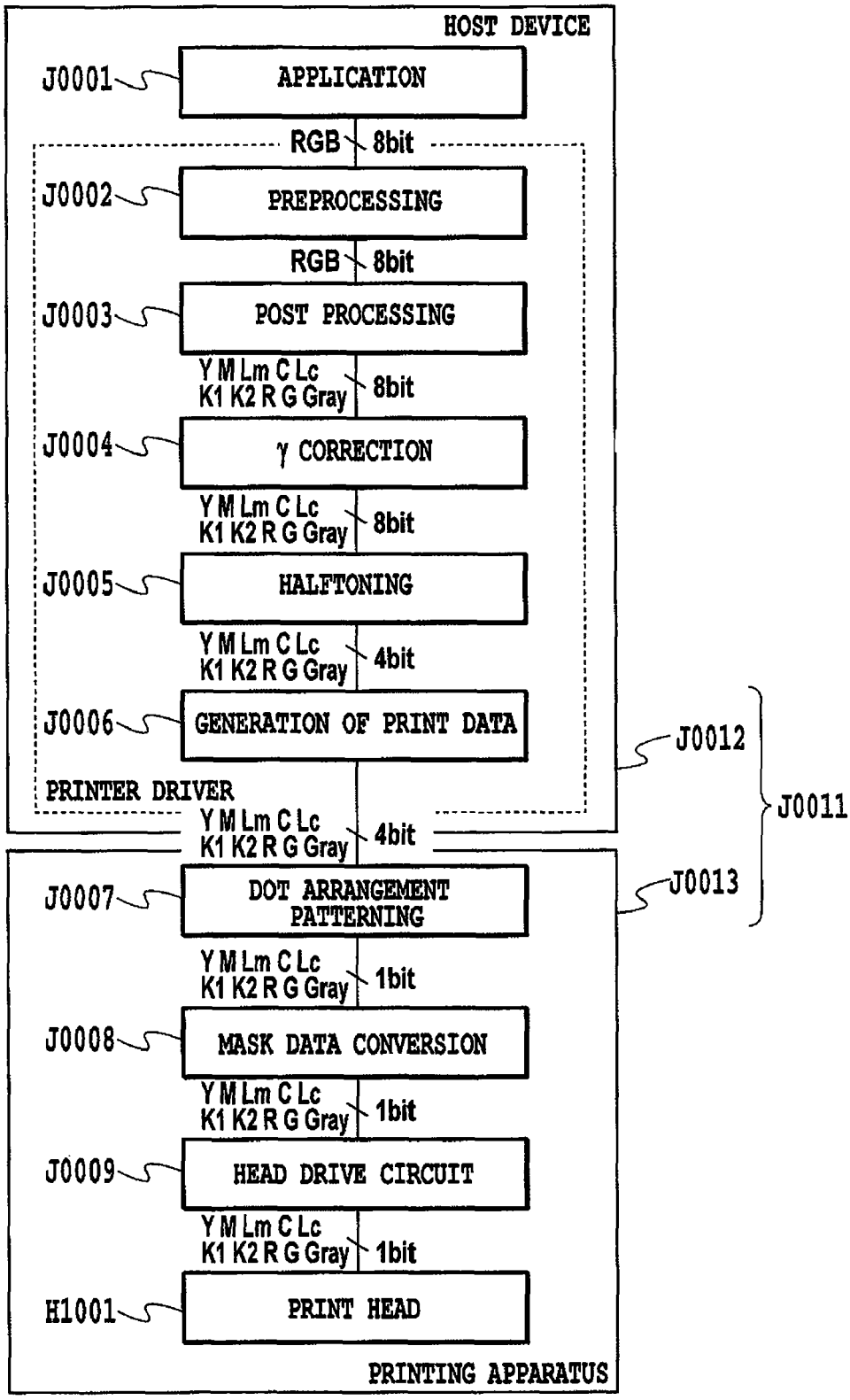
FIG. 3 illustrates a flow of image data processing in a print system applied to an embodiment of this invention.

FIG. 3 shows a flow of image data processing in a print system applied to the embodiment of this invention. The print system J0011 has a host device J0012 that generates image data representing an image to be printed and sets a UI (user interface) for data generation. It also has a printing apparatus J0013 that prints on a print medium according to the image data generated by the host device J0012. The printing apparatus J0013 uses 10 color inks—cyan (C), light cyan (Lc), magenta (M), light magenta (Lm), yellow (Y), red (R), green (G), first black (K1), second black (K2) and gray (Gray). Thus it uses a print head H1001 that ejects these 10 color inks. The 10 color inks are pigment inks containing pigments as coloring materials.

Among programs that run on an operating system of the host device J0012 are applications and a printer driver. The application J0001 generates image data to be printed by the printing apparatus. On a U1 screen of a monitor of the host device J0012, the user makes setting on such items as a kind of print medium to be used for printing and a print quality and issues a print command. In response to this print command, image data R, G, B is handed over to the printer driver.

The printer driver has, as its functions, preprocessing J0002, post processing J0003, γ correction J0004, half toning J0005 and print data generation J0006. These processing J0002-J0006 executed by the printer driver will be briefly explained as follows.

(A) Preprocessing

The preprocessing J0002 performs mapping of a gamut or color space. In this embodiment, it performs data conversion to map the gamut reproduced by image data R, G, B of standard color space, sRGB, into a color space reproduced by the printing apparatus J0013. More specifically, it transforms 8-bit, 256-grayscale image data R, G, B into 8-bit data R, G, B in the color space of the printing apparatus J0013 by using a three-dimensional LUT.

(B) Post Processing

The post processing J0003 determines 8-bit, 10-color component data Y, M, Lm, C, Lc, K1, K2, R, G, Gray corresponding to a combination of inks that reproduces a color represented by the color space-mapped 8-bit data R, G, B. In this embodiment, the post processing also performs an interpolation calculation using the three-dimensional LUT, as in the preprocessing.

(C) γ Correction

The γ correction J0004 performs a density (grayscale value) conversion on the color component data for each color that was calculated by the post processing J0003. More specifically, by using a one-dimensional LUT corresponding to a grayscale characteristic of each color ink of the printing apparatus J0013, the γ correction performs a conversion that linearly matches the color component data to the grayscale characteristic of the printing apparatus.

(D) Half Toning

The half toning J0005 executes a quantization that transforms each of the γ-corrected 8-bit color component data Y, M, Lm, C, Lc, K1, K2, R, G, Gray into 4-bit data. In this embodiment the 256-grayscale 8-bit data is transformed into 9-grayscale 4-bit data by using the error diffusion method. The 4-bit data is an index representing a dot pattern formed by the dot arrangement patterning processing in the printing apparatus.

(E) Print Data Generation

As the last processing executed by the printer driver, the print data generation J0006 adds print control information to the image data represented by the 4-bit index data to generate print data. The print data comprises the print control information used to control the printing operation and the image data representing an image to be printed (4-bit index data). The print control information includes, for example, "print medium information", "print quality information" and "other control information" such as "paper feeding method". The print data generated as described above is supplied to the printing apparatus J0013.

The printing apparatus J0013 performs dot arrangement patterning J0007 and mask data conversion J0008, described below, on the print data supplied from the host device J0012.

(F) Dot Arrangement Patterning

The above half toning J0005 reduces the grayscale level from the 256-multivalued density information (8-bit data) to 9-valued grayscale information (4-bit data). However, the data the printing apparatus J0013 can actually print is binary data (1-bit data) indicating whether or not to print an ink dot. So, to each pixel represented by the 4-bit data of grayscale level 0-8 output from the half toning J0005, the dot arrangement patterning J0007 allots a dot arrangement pattern corresponding to the grayscale level (0-8) of the pixel. That is, each of a plurality of sub-areas making up one pixel is given on/off data—1-bit binary data "1" or "0"—specifying whether or not an ink dot is to be printed in that sub-area. Here "1" specifies that a dot is to be printed in the sub area of interest and "0" specifies that a dot is not to be printed.

Figure 4:
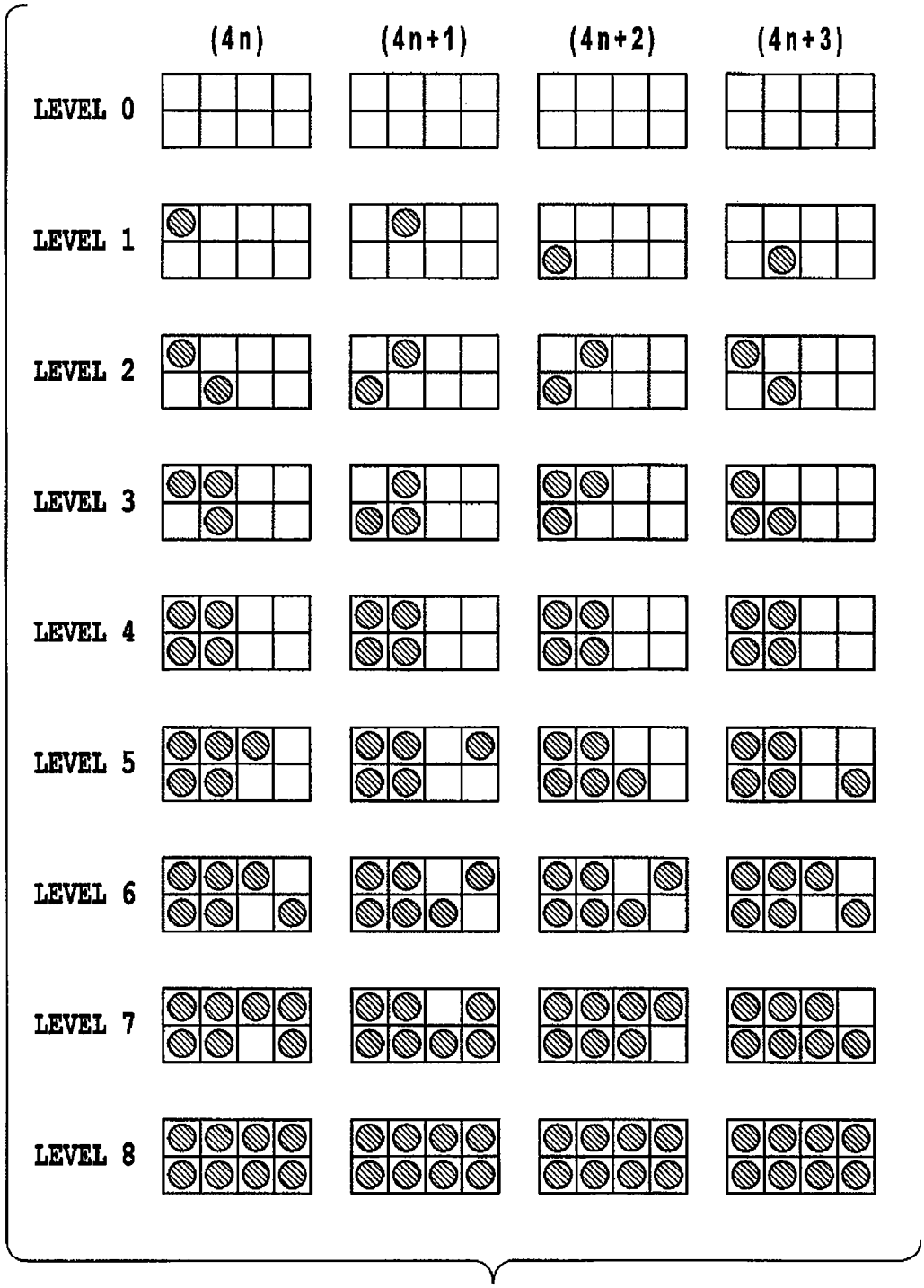
FIG. 4 illustrates output patterns that dot arrangement patterning processing of the embodiment produces for input levels 0-8.

FIG. 4 shows output patterns that the dot arrangement patterning of this embodiment generates for input levels 0-8. The levels shown to the left of the figure correspond to level 0 to level 8, output from the half toning on the host device. Areas shown to the right, each made up of 2 vertical sub-areas by 4 horizontal sub-areas, constitute one pixel area output by the half toning. Each of the sub-areas in one pixel represents a minimum unit area in which a dot on/off is defined. In this specification the "pixel" refers to a minimum unit area that can be represented in grayscale and which constitutes a minimum unit that is handled by two- or more-bit, multivalued data image processing (e.g., the preprocessing, post processing, γ correction and half toning).

In the figure, sub-areas marked with a circle represent those where a dot is to be printed. As the level increases, the number of dots in one pixel increases one at a time. In this embodiment, the density information of an original image is reflected in this manner.

(4*n*) to (4*n*+3) represent horizontal pixel positions from the left end of the image data which are determined by substituting an integer equal to 1 or more into n. Dot patterns presented in these columns show that four different dot patterns are prepared for one and the same input level according to pixel position. That is, if the same input level is entered, four dot arrangement patterns shown in the columns (4*n*) to (4*n*+3) are cyclically allotted.

In FIG. 4 the vertical direction is taken to be a direction in which nozzle openings of the print head are arrayed and the horizontal direction is taken to be a direction of scan of the print head. Printing the same level of print data in a plurality of different dot arrangements produces an effect of dispersing the number of ejections among the nozzles situated in the upper tier of the dot arrangement pattern and the nozzles situated in the lower tier and also an effect of spreading various noise characteristic of the printing apparatus.

With the above dot arrangement patterning completed, all dot arrangement patterns to be printed on the print medium are determined.

(G) Mask Data Conversion

The above dot arrangement patterning J0007 determines the presence or absence of dot in individual sub-areas on the print medium. Thus, entering binary data representing the dot arrangement to a drive circuit J0009 of the print head H1001 enables a desired image to be printed. In printing the image, a so-called 1-pass printing is executed which completes the printing of one and the same scan area of the print medium in a single scan. Here, we take for example a multi-pass printing which completes the printing on the same scan area on the print medium in multiple scans.

Figure 5:
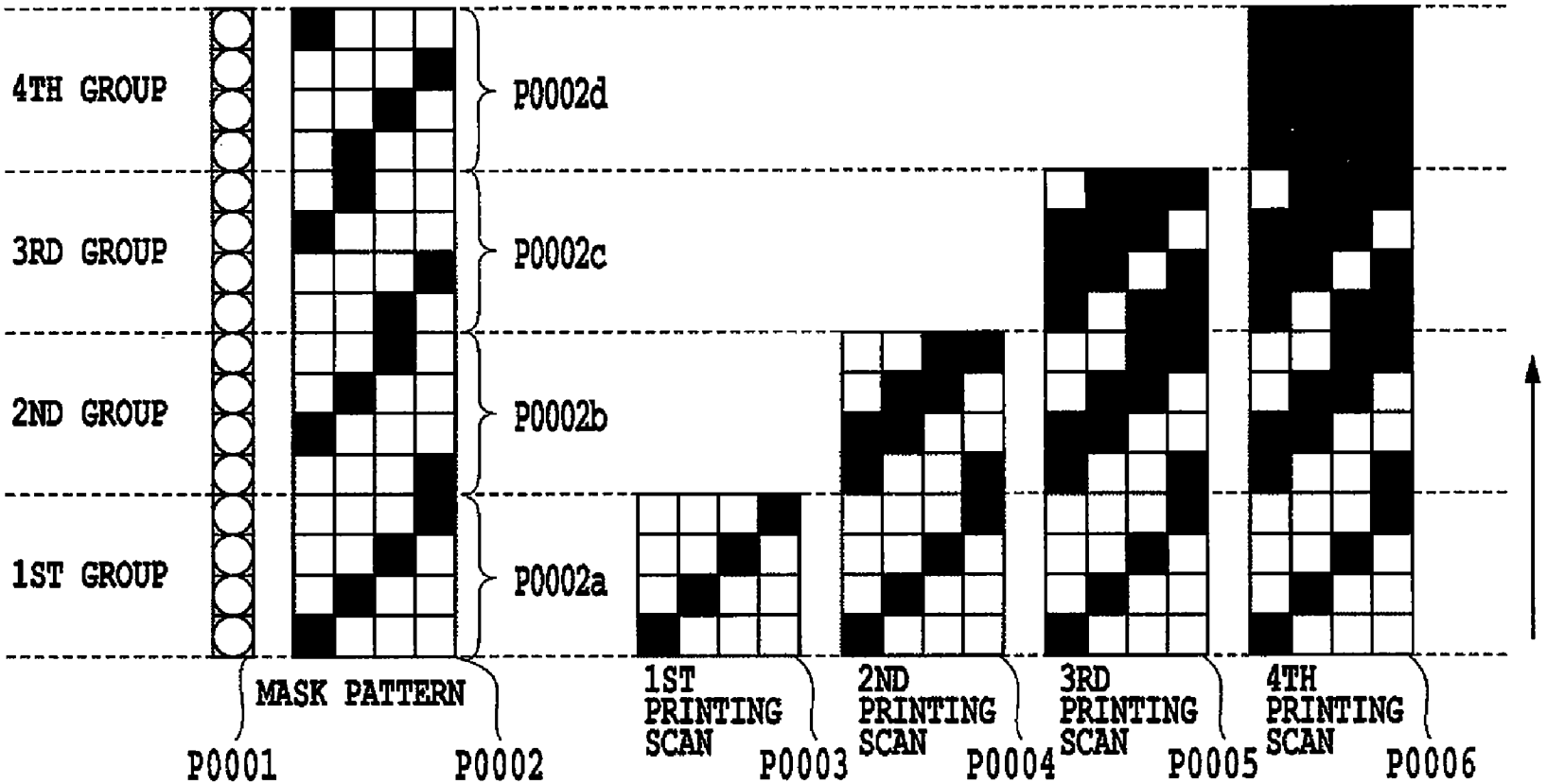
FIG. 5 schematically illustrates a print head and printed patterns to explain a multipass printing method.

FIG. 5 schematically shows a print head and print patterns to explain the multipass printing method. The print head H1001 used in this embodiment has 768 nozzles. For the sake of simplicity, the print head is described as a print head P0001 having 16 nozzles. The nozzles are divided into four nozzle groups, first to fourth nozzle group, as shown in the figure, with each nozzle group having four nozzles. A mask pattern P0002 comprises first to fourth mask pattern P0002*a*-P0002*d*. The first to fourth mask pattern P0002*a*-P0002*d* each defines areas that the first to fourth nozzle group can print. Areas in the mask pattern that are painted black represent print permission area and blank areas represent print non-permission areas. The first to fourth mask patterns P0002*a*-P0002*d* are complementary to one another and superimposing these four mask patterns completes the printing of a 4×4 area.

Patterns at P0003-P0006 show how an image is formed as the overlapping printing scans are performed. Each time the printing scan is completed, the print medium is fed a width of each group in the direction of an arrow in the figure (in this figure, a distance equal to four nozzles). Therefore, an image in one and the same area of the print medium (an area corresponding to the width of each nozzle group) is completed in four printing scans. As described above, forming an image in each area of the print medium in a plurality of scans by a plurality of nozzle groups has an effect of reducing variations characteristic of nozzles and feeding accuracy variations of the print medium.

Figure 6:
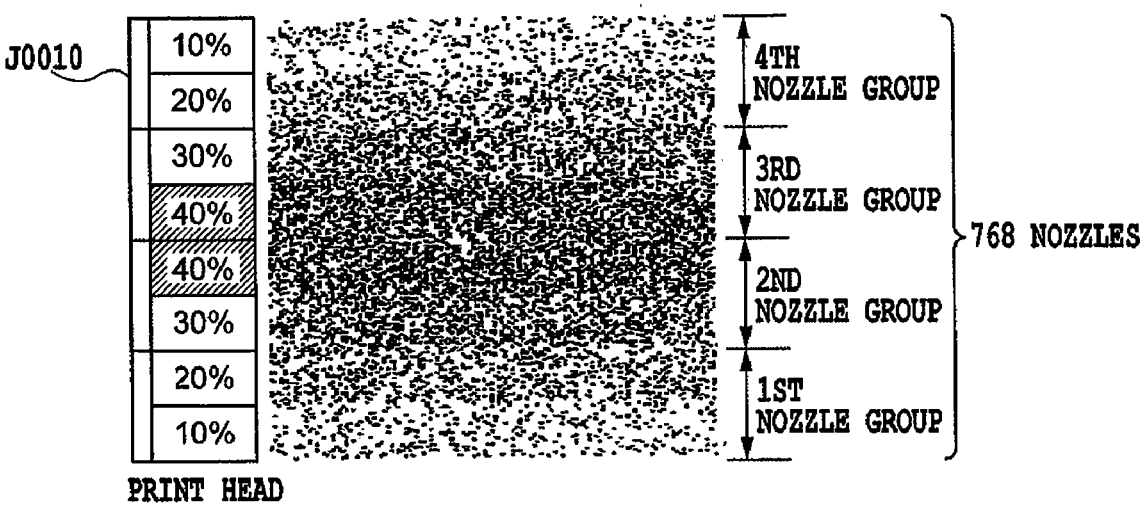
FIG. 6 illustrates one example of mask pattern applicable to the embodiment.

FIG. 6 shows one example of mask pattern applicable to this embodiment. A print head J0010 used in this embodiment has 768 nozzles, which are divided into four groups of 192 nozzles. The mask pattern measures 768 vertically extending sub-areas by 256 horizontally extending sub-areas. Four mask patterns corresponding to the four nozzle groups are complementary to one another.

In this embodiment, the mask data shown in FIG. 6 is stored in a memory in the printing apparatus. The mask data conversion J0008 executes an AND operation on the mask data and the binary data obtained by the dot arrangement patterning to determine binary data to be printed in each printing scan and sends it to the drive circuit J0009, which in turn drives the print head J0010 to eject ink according to the binary data.

In FIG. 3, the preprocessing J0002, post processing J0003, γ correction J0004, half toning J0005 and print data generation J0006 are executed by the host device J0012. The dot arrangement patterning J0007 and the mask data conversion J0008 are executed by the printing apparatus J0013. It is noted, however, that the present invention is not limited to this embodiment. For example, a part of above processing J002-J0005 may be executed by the printing apparatus J0013, or all of processing J002-J0008 may be executed by the host device J0012. Alternatively, the processing J002-J0008 may be executed by the printing apparatus J0013.

1.2 Construction of Mechanical Unit

The construction Of the printing apparatus applied to this embodiment will be described as follows. The printing apparatus of this embodiment generally comprises, in terms of function, a paper supply unit, a paper transport unit, a paper discharge unit, a carriage unit and a cleaning unit, and these units are accommodated in and protected by an enclosure.

Figure 7:
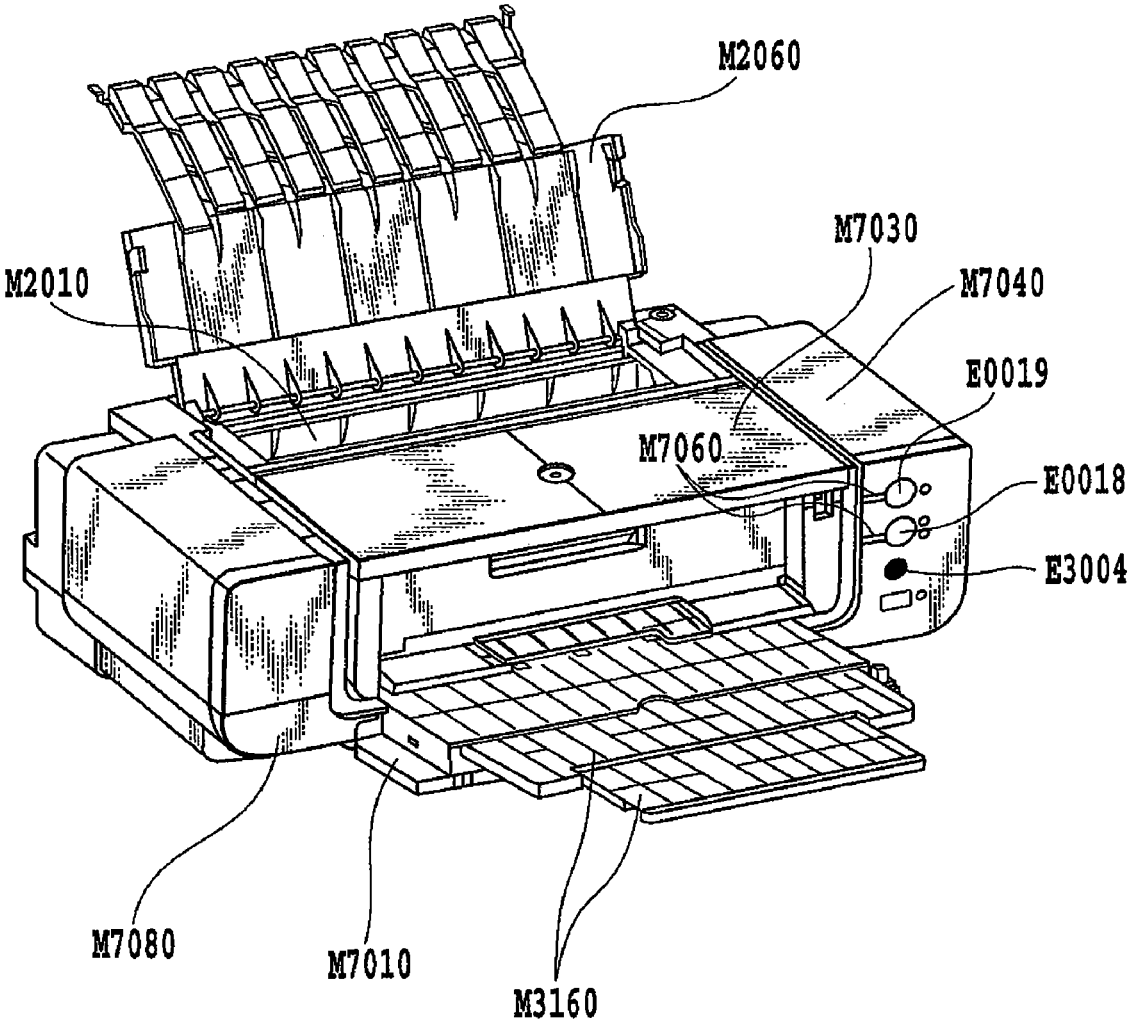
FIG. 7 is a perspective view of a printing apparatus applicable to the embodiment of this invention, as seen diagonally from a right upper part of the printing apparatus.

FIG. 7 is a perspective view of the printing apparatus as seen diagonally from its right upper portion. An enclosure of the printing apparatus comprises mainly a lower case M7080, an upper case M7040, an access cover M7030, a connector cover not shown and a front cover M7010, enclosing an internal construction of the apparatus. The upper case M7040 is provided with an LED guide M7060 that transmits and displays LED light, a power key E0018, a resume key E0019 and a flat-pass key E3004. A paper supply tray M2060 and a paper discharge tray M3160 are pivotally mounted and, when paper is supplied and discharged, can be extended stepwise as shown. When paper supply and discharge are not performed, they are folded to cover the apparatus.

Figure 8:
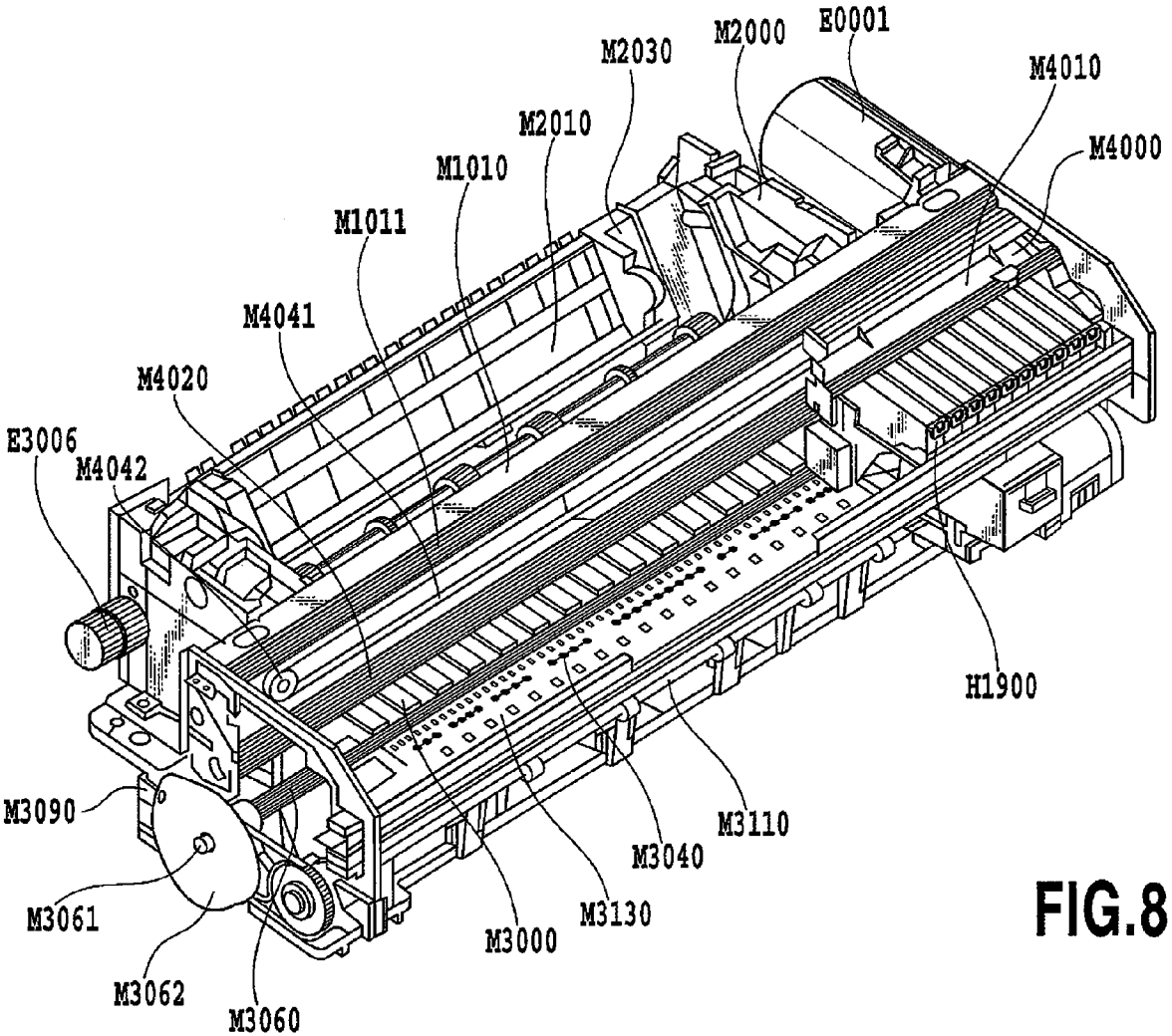
FIG. 8 is a perspective view of the printing apparatus applicable to the embodiment of this invention, showing an internal construction of the printing apparatus.
Figure 9:
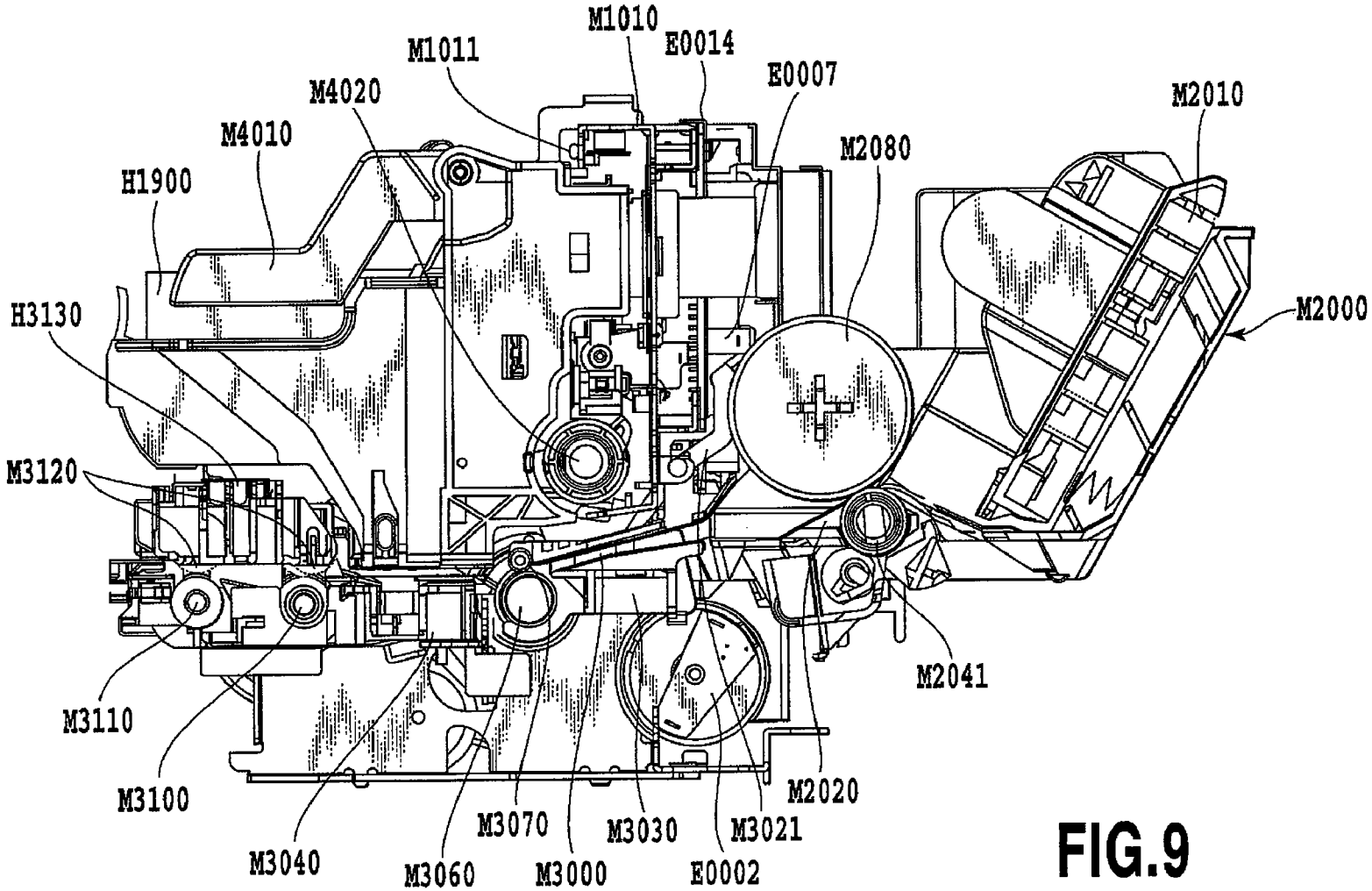
FIG. 9 is a cross-sectional view of the printing apparatus applicable to the embodiment of this invention, showing the internal construction of the printing apparatus.

FIG. 8 is a perspective view of the printing apparatus with the enclosure removed. FIG. 9 is a cross-sectional view of the apparatus.

A base M2000 has mounted thereon a pressure plate M2010 on which to put a stack of print medium sheets, a paper supply roller M2080 to feed sheets of print medium one at a time, a separation roller M2041 to separate a sheet from the stack and a return lever M2020 to return a print medium to the stack position, all combining to form a paper supply mechanism.

A chassis M1010 formed of a bent metal sheet has pivotally mounted thereon a transport roller M3060 to transport the print medium and a paper end sensor E0007.

The transport roller M3060 has a plurality of follower pinch rollers M3070 pressed against it. The pinch rollers M3070 are supported on a pinch roller holder M3000 and biased by pinch roller springs not shown so that they are pressed against the transport roller M3060 to generate a print medium transport force.

In a path along which the print medium is transported, a paper guide flapper M3030 to guide the print medium and a platen M3040 are installed. The pinch roller holder M3000 is attached with a PE sensor lever M3021 which transmits a timing signal indicating when it has detected the front and rear end of the print medium to the PE sensor E0007 fixed on the chassis M1010.

The drive force for the transport roller M3060 is provided by an LF motor E0002, which may be a DC motor for example, whose rotating force is transmitted through a timing belt to a pulley M3061 arranged on a shaft of the transport roller M3060. Also on the shaft of the transport roller M3060, there is a code wheel M3062 for detecting a transport distance of the print medium transported by the transport roller M3060. On the adjoining chassis M1010 is installed an encode sensor M3090 to read a marking formed on the code wheel M3062.

A first discharge roller M3100, a second discharge roller M3110, a plurality of spurs M3120 and a gear train combine to form the paper discharge mechanism. A drive force for the first discharge roller M3100 is provided by the transport roller M3060 whose rotating force is transmitted through idler gears. A drive force for the second discharge roller M3110 is provided by the first discharge roller M3100 whose rotating force is conveyed through idler gears.

The spurs M3120 is formed of a circular thin plate integrally molded with a resin portion which has a plurality of protrusions along its circumference. Two or more of them are mounted on the spur holder M3130.

The print medium with a printed image is nipped and transported by the second discharge roller M3110 and spurs M3120 and discharged onto the paper discharge tray M3160.

Denoted M4000 is a carriage on which to mount the print head H1001 and which is supported on a guide shaft M4020 and a guide rail M1011. The guide shaft M4020 is mounted on the chassis M1010 and guides the carriage M4000 for reciprocal scan in a direction crossing the transport direction of the print medium. The guide rail M1011 is formed integral with the chassis M1010 and holds a rear end portion of the carriage M4000 to maintain a predetermined gap between the print head H1001 and the print medium.

The carriage M4000 is reciprocally driven by a carriage motor E0001 on the chassis M1010 through a timing belt M4041 that is stretched and supported by an idle pulley M4042.

An encoder scale (not shown) formed with markings at a predetermined pitch is arranged parallel to the timing belt M4041. An encoder sensor on the carriage M4000 reads the marking on the encoder scale. A present position of the carriage M4000 can be identified based on the detected value of the encoder sensor.

The print head H1001 of this embodiment has ink tanks H1900 for 10 color inks removably mounted thereon. The print head H1001 is removably mounted on the carriage M4000. The carriage M4000 has an abutment portion to position the print head H1001 and a pressing means mounted on a head set lever M4010.

In forming an image on a print medium using the above construction, the following procedure is taken. As for the row position, the print medium is transported and positioned by a pair of rollers made up of the transport roller M3060 and pinch rollers M3070. As for the column position, the carriage M4000 is moved by the carriage motor E0001 in a direction perpendicular to the transport direction to locate the print head H1001 at a target image forming position. The print head H1001 thus positioned then ejects ink according to a signal received from the main printed circuit board E0014.

In the printing apparatus of this embodiment, an image is formed on the print medium successively by repetitively alternating the printing action of the print head in the main scan direction and the feeding of the print medium in the subscan direction.

1.3 Electric Circuit Configuration

Figure 10:
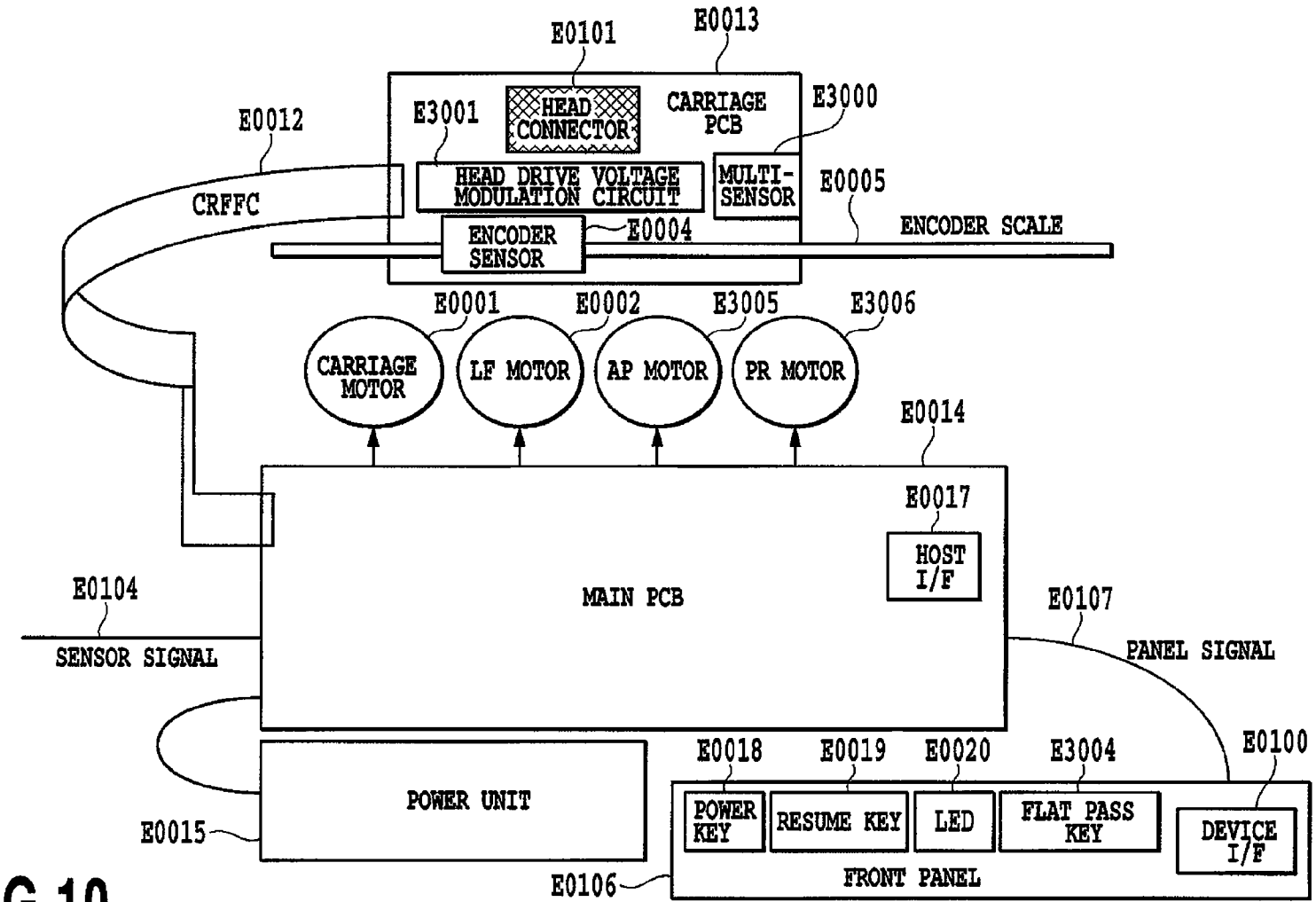
FIG. 10 is a block diagram schematically showing an overall configuration of an electric circuit in the ink jet printing apparatus applied to the embodiment of this invention.

FIG. 10 is a block diagram schematically showing an electric circuitry of the printing apparatus J0013. The electric circuit of this embodiment mainly comprises a carriage printed circuit board E0013, a main printed circuit board E0014, a power unit E0015 and a front panel E0106.

The power unit E0015 is connected to the main printed circuit board E0014 to supply electricity to various drive units.

The carriage printed circuit board E0013 is mounted on the carriage M4000 and has an interface function, including transferring signals to and from the print head H1001 through a head connector E0101 and supplying a head drive power. A head drive voltage modulation circuit (voltage adjustment circuit) E3001 controls the power supply to the print head and has a plurality of channels corresponding to a plurality of color nozzle columns mounted on the print head H1001. According to signals received from the main printed circuit board E0014 through a flexible flat cable (CRFFC) E0012, the head drive voltage modulation circuit E3001 generates a head drive voltage for each channel.

The encoder sensor E0004 reads a pattern of the encoder scale E0005 fixed in the printing apparatus as the carriage M4000 moves during the scan, and then transmits a reading in the form of a pulse signal to the main printed circuit board E0014 through the flexible flat cable (CRFFC) E0012. Based on this output signal, the main printed circuit board can detect the position of the encoder sensor E0004 with respect to the encoder scale E0005, i.e., the position of the carriage.

The carriage printed circuit board E0013 is connected with an optical sensor made up of two light emitting devices and two light receiving devices and also with a thermistor that detects an ambient temperature (these sensors are generally referred to as a multisensor E3000). Information acquired by the multisensor E3000 is output through the flexible flat cable (CRFFC) E0012 to the main printed circuit board E0014.

The main printed circuit board E0014 controls various drive units in the ink jet printing apparatus. The main printed circuit board E0014 has a host interface (host I/F) E0017 for data transfer to and from the host computer not shown and performs a print control according to the data received through the host interface.

The main printed circuit board E0014 is connected with the carriage motor E0001, LF motor E0002, AP motor E3005 and PR motor E3006 and controls these motors. The carriage motor E0001 is a drive source for the main scan of the carriage M4000. The LF motor E0002 is a drive source for the transport of the print medium. The AP motor E3005 is a drive source for the recovery operation of the print head H1001 and for the supply of the print medium. The PR motor E3006 is a drive source for the flat-pass (horizontal transport).

Further, the main printed circuit board E0014 is connected to a sensor signal E0104 and receives output signals from the PE sensor, CR lift sensor, LF encoder sensor and PG sensor that represent operation states of various portions and transmits control signals according to the sensor signals.

The main printed circuit board E0014 is connected to the CRFFC E0012 and the power unit E0015. It also has an interface for data transfer to and from the front panel E0106 through a panel signal E0107.

The front panel E0106 is a unit installed at the front of the printing apparatus body for easy operation on the part of the user. This unit has a resume key E0019, LED E0020, power key E0018 and flat-pass key E3004. It also has a device I/F E0100 for connection with peripheral devices such as digital camera.

Figure 11:
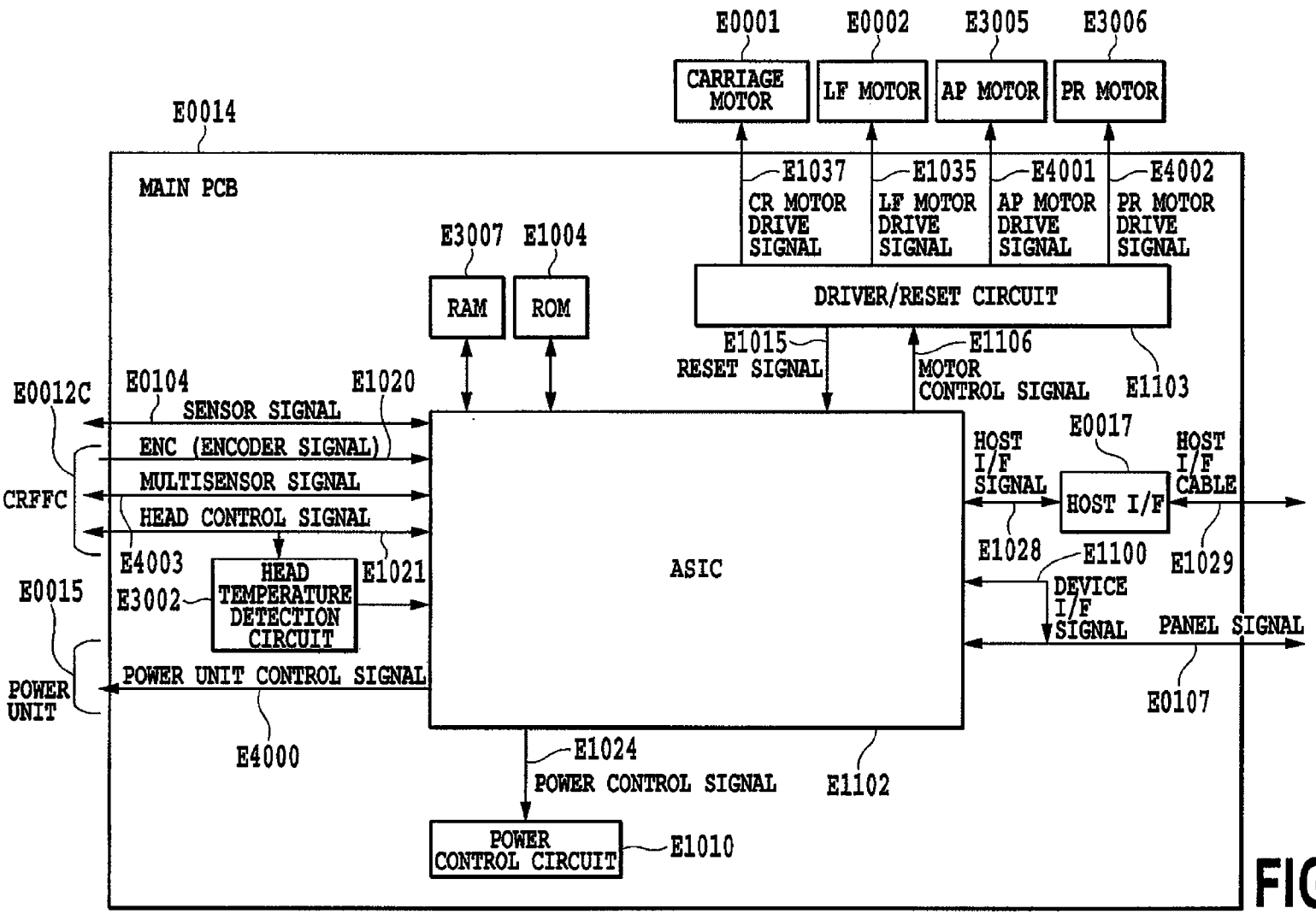
FIG. 11 is a block diagram showing an internal configuration of a main printed circuit board in the ink jet printing apparatus applied to the embodiment of this invention.

FIG. 11 is a block diagram showing an internal configuration of the main printed circuit board E0014.

In the figure, denoted E1102 is an ASIC (Application Specific Integrated Circuit). ASIC E1102 includes a so-called CPU. The ASIC E1102 performs various controls on the printing apparatus as a whole according to programs stored in a ROM E1004 connected to it through control bus E1014. In addition to programs, the ROM E1004 also stores parameters and tables used in controlling various mechanical units. Tables include information about waveforms (amplitudes and pulse widths) of pulse signals that drive the print head, as shown in FIG. 24. The ASIC E1102 controls the operation of the printing apparatus as a whole by performing various settings and logic operations and making condition judgment by referring to parameters stored in the ROM E1004 as required. At this time a RAM E3007 is used as a data buffer for printing and for receiving data from the host computer and also as a work area necessary for various controls.

Image data entered from the device I/F E0100 is transmitted as a device I/F signal E1100 to the ASIC E1102. Image data that the host I/F E0017 receives from the host device through a host I/F cable E1029 is sent as a host I/F signal E1028 to the ASIC E1102. Upon receiving these image data, the ASIC E1102 performs a printing operation based on various detection signals and setting signals.

Data detected by various sensors in the printing apparatus are transmitted as the sensor signal E0104 to the ASIC E1102. A signal E4003 from the multisensor E3000, a signal E1020 from the encoder sensor E0004, a temperature signal from the print head and a heater rank of each nozzle column of the print head are also transferred to the ASIC E1102 through the CRFFC E0012. The temperature signal of the print head is amplified by a head temperature detection circuit E3002 on the main printed circuit board before being input to the ASIC E1102. The ASIC E1102 acquires the temperature signal periodically. Further, data from the power key E0018, resume key E0019 and flat pass key E3004 on the front panel E0106 are also supplied as the panel signal E0107 to the ASIC E1102. The ASIC E1102 uses these input signals as decision factors to issue control signals to various mechanical units.

For example, based on the position information from the encoder signal E1020 and the temperature information from the head temperature detection circuit E3002, the ASIC E1102 outputs a head control signal E1021 for the control of the ejection timing and ejection volume. This head control signal E1021 is supplied to the print head H1001 through the head drive voltage modulation circuit E3001 and the head connector E0101, both explained in FIG. 10.

Denoted E1103 is a driver/reset circuit. The ASIC E1102 issues a motor control signal E1106 for various motors to the driver/reset circuit E1103. According to the received motor control signal E1106, the driver/reset circuit E1103 generates a CR motor drive signal E1037, an LF motor drive signal E1035, an AP motor drive signal E4001 and a PR motor drive signal E4002 to drive the associated motors. The driver/reset circuit E1103 has a power supply circuit and supplies electricity to the main printed circuit board E0014, carriage printed circuit board E0013 and front panel E0106. When a power supply voltage drop is detected, the driver/reset circuit E1103 generates a reset signal E1015 and initializes the mechanical units.

Denoted E1010 is a power supply control circuit which controls the power supply to various sensors having light emitting devices according to a power supply control signal E1024 from the ASIC E1102.

The power for main printed circuit board E0014 is supplied by the power unit E0015. When a voltage transformation is required, the power is voltage-transformed before being supplied to various parts in and out of the main printed circuit board E0014. A power unit control signal E4000 from the ASIC E1102 is connected to the power unit E0015 to allow a switch to a low power consumption mode of the printing apparatus.

1.4 Print Head Construction

Figure 12:
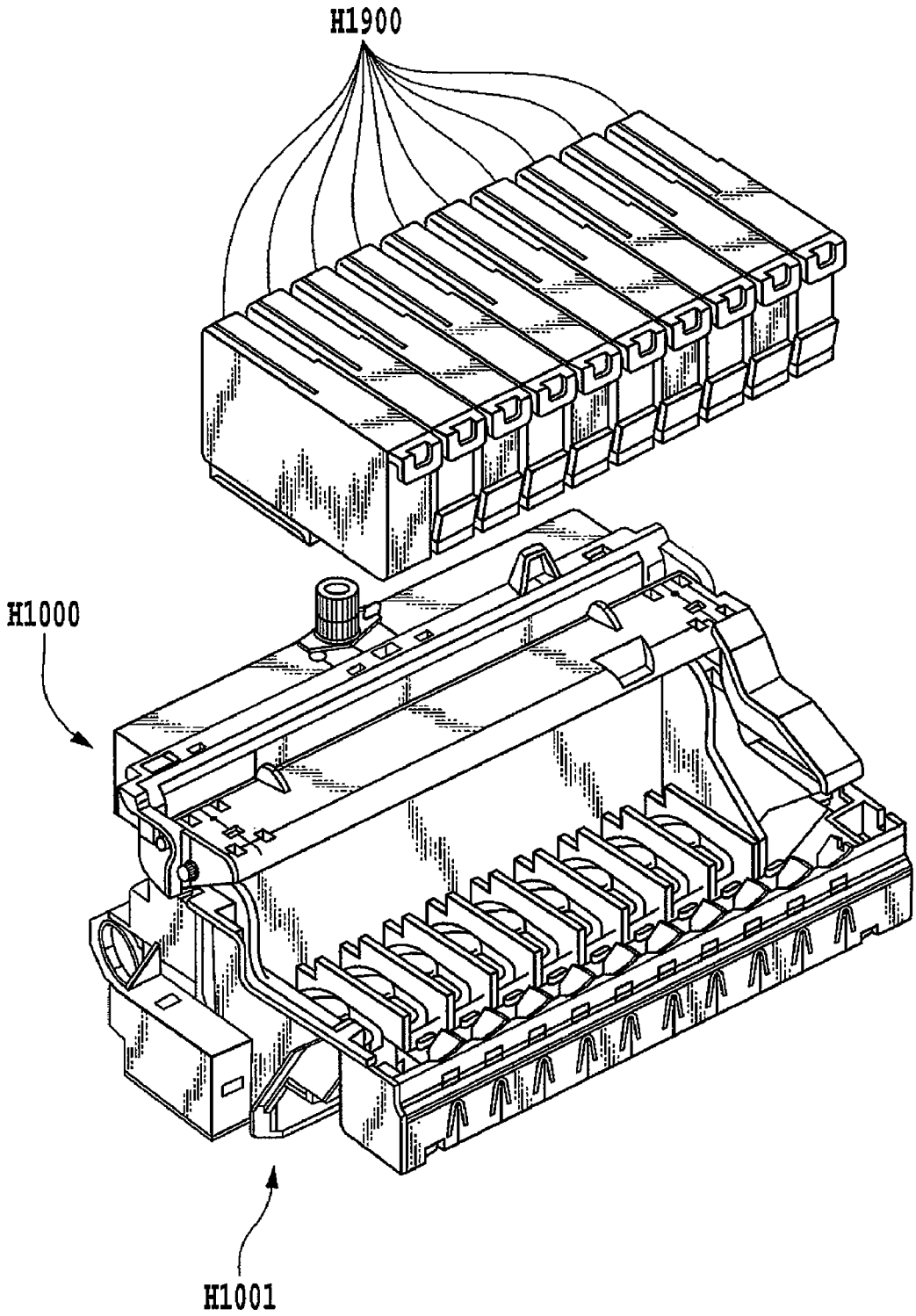
FIG. 12 is a schematic view showing a construction of a head cartridge applied to the embodiment of this invention.

FIG. 12 is a schematic perspective view showing a construction of the head cartridge H1000 applied to this embodiment. The head cartridge H1000 of this embodiment has a means in which to mount the print head H1001 and the ink tanks H1900 and a means to supply ink to the print head. The head cartridge H1000 is removably mounted in the carriage M4000.

This embodiment provides an ink tank H1900 for each of 10 color inks. Each of the ink tanks is removably mounted on the head cartridge H1000. The mounting and dismounting of the ink tanks H1900 can be done with the head cartridge H1000 mounted in the carriage M4000.

The print head H1001 has heaters (electrothermal transducers) installed one in each ink path communicating to an ink ejection opening and ejects ink by using a thermal energy of the heaters. More specifically, a drive voltage is applied to a heater to rapidly heat ink in the ink path to form an expanding bubble which in turn expels ink from a nozzle opening.

Figure 13:
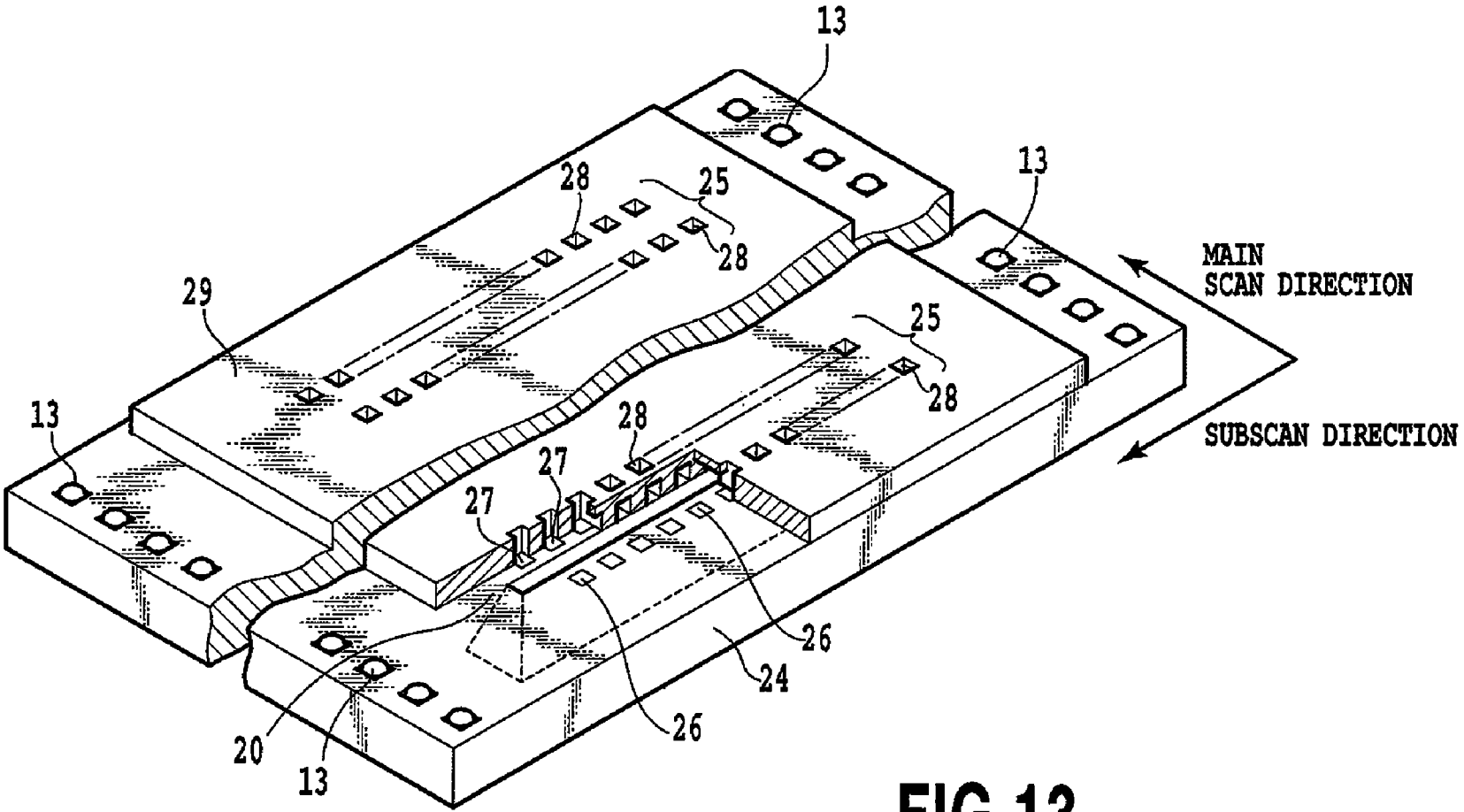
FIG. 13 is a schematic perspective view showing a structure of an ejecting portion of the print head used in the embodiment of this invention.

FIG. 13 is a schematic perspective view showing a structure of an ejecting portion of the print head H1001. In the figure, denoted 24 is a substrate formed of a silicon wafer. The substrate 24 constitutes a part of an ink path member and also functions as a support for a layer that forms the heaters, the ink paths and the nozzle openings. In this embodiment, the substrate 24 may use other materials than silicon, such as glass, ceramics, plastics or metals.

On the substrate 24 heaters 26 as a thermal energy generation means are arrayed at a pitch of 600 dpi in the subscan direction on both sides of an ink supply port along its length. These two columns of heaters are staggered a half pitch in the subscan direction.

On the substrate 24 is bonded a cover resin layer 29 that introduces ink to the individual heaters. Formed in the cover resin layer 29 are flow paths (or liquid paths) 27 at positions corresponding to individual heaters and a common ink supply port 20 capable of supplying ink to the individual flow paths 27. Front end portions of the flow paths 27 constitute nozzle openings from which an ink droplet caused by the film boiling formed by the heater 26 is ejected. Denoted 13 are electrodes to apply a voltage pulse to the individual heaters 26.

In the above construction, applying a voltage to the individual heaters at a predetermined timing as the print head moves in the main scan direction enables ink droplets supplied from the same ink supply port 20 to be printed onto the print medium at a resolution of 1,200 dpi in the subscan direction.

One ink supply port 20 is supplied one ink and a plurality of such ink supply ports 20 are parallelly formed in one substrate 24 and can eject different inks. Although two columns of print elements (two nozzle columns) are shown in the figure, the print head of this embodiment actually has five nozzle columns in one substrate capable of ejecting five inks. Two such substrates are arranged side by side so that the print head of this embodiment can eject 10 color inks.

2. Characteristic Construction

The general construction of the printing apparatus of this embodiment has been described. Next, a construction characteristic of this invention will be described in detail. First, the head drive voltage modulation circuit to apply an appropriate voltage to the print head will be explained.

Referring to FIG. 10, the head drive voltage modulation circuit E3001 of this embodiment modulates an input voltage supplied from the power unit E0015 through the main printed circuit board E0014 to a voltage specified by the main printed circuit board and supplies the modulated voltage as an output voltage VH to the head connector E0101.

Figure 14:
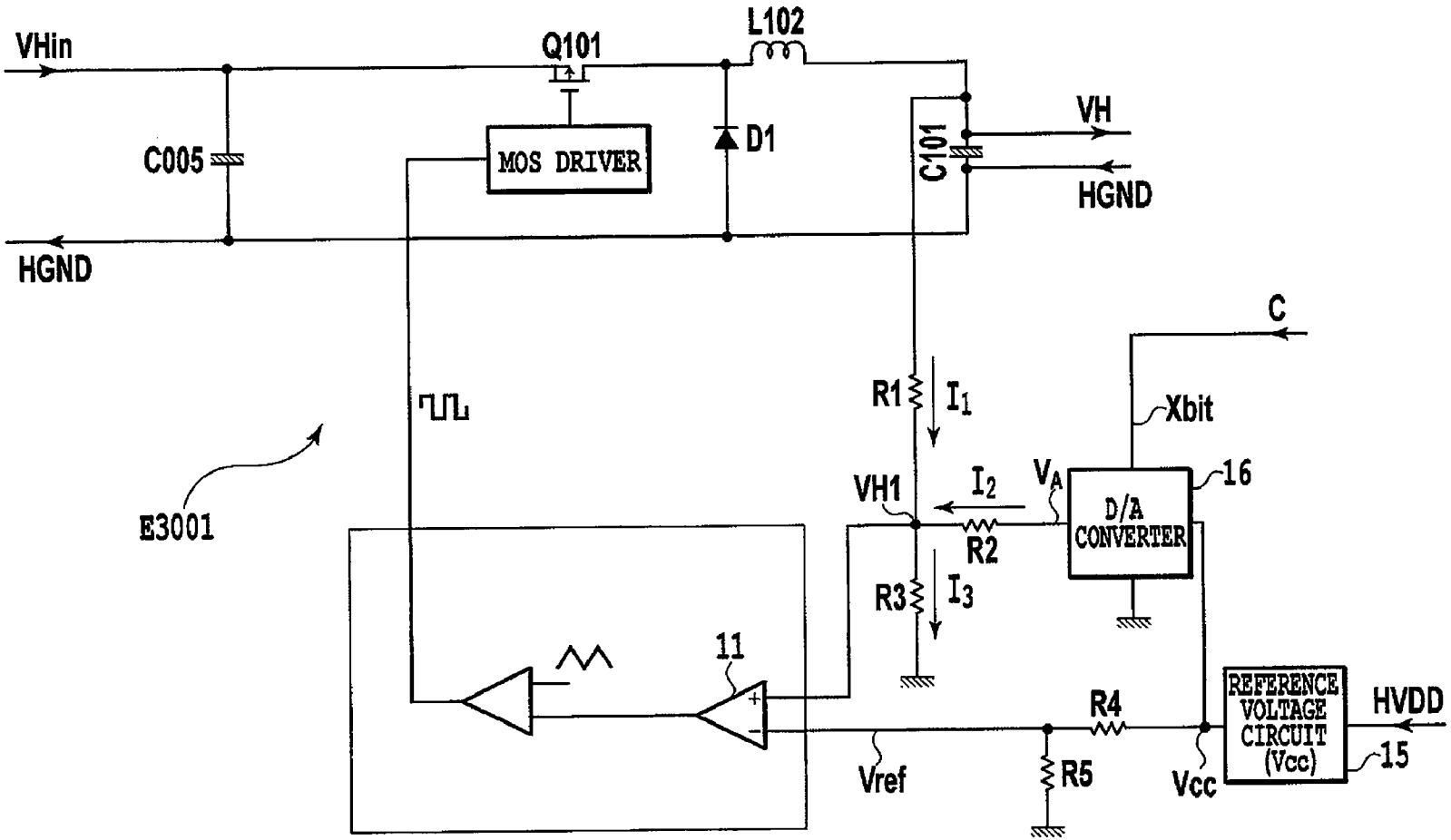
FIG. 14 is a circuit diagram showing an example configuration of a head drive voltage modulation circuit arranged on a carriage printed circuit board.

FIG. 14 is a circuit diagram showing an example configuration of the head drive voltage modulation circuit E3001 arranged on the carriage printed circuit board E0013. In the figure, denoted HVDD is a control signal to turn on/off a reference voltage circuit 15. Denoted C is an 8-bit control signal to set a voltage applied to the print head. Denoted VH is a voltage actually applied to the print head. A reference voltage VCC after being transformed by the reference voltage circuit 15 is entered into a D/A converter 16 where it is transformed to an output voltage VA according to the control signal C. Since the control signal C is an 8-bit digital signal, an output of the D/A converter 16 can be adjusted in 256 steps. Suppose, for example, the 8-bit control signal C has a value of X. Then, the output voltage VA of the D/A converter 16 is expressed as $$VA=Vcc\times X/256$$

A current I2 corresponding to the output voltage VA is added through a resistor R2 to a voltage dividing point between resistors R1 and R2. A voltage VH1 applied to a non-inverted terminal of a differential amplifier 11 is controlled to minimize a difference between it and a reference voltage Vref supplied to the inverted terminal. So, currents I1, I2, I3 flowing through resistors R1, R2, R3 are given as follows:

$$I1=(VH-Vref)/R1$$

$$I2=(VA-Vref)/R2$$

$$I3=Vref/R3$$

Further, according to Kirchhoff's current law, $$I1+I2=I3$$

Therefore, $$(VH-Vref)/R1+(VA-Vref)/R2=Vref/R3$$

And the output voltage VH is expressed as $$VH=Vref+R1\times\{Vref/R3+(Vref-VA)/R2\}$$

That is, the ASIC E1102 can adjust the voltage VH applied to the print head by appropriately changing the control signal C to the D/A converter 16.

Figure 15:
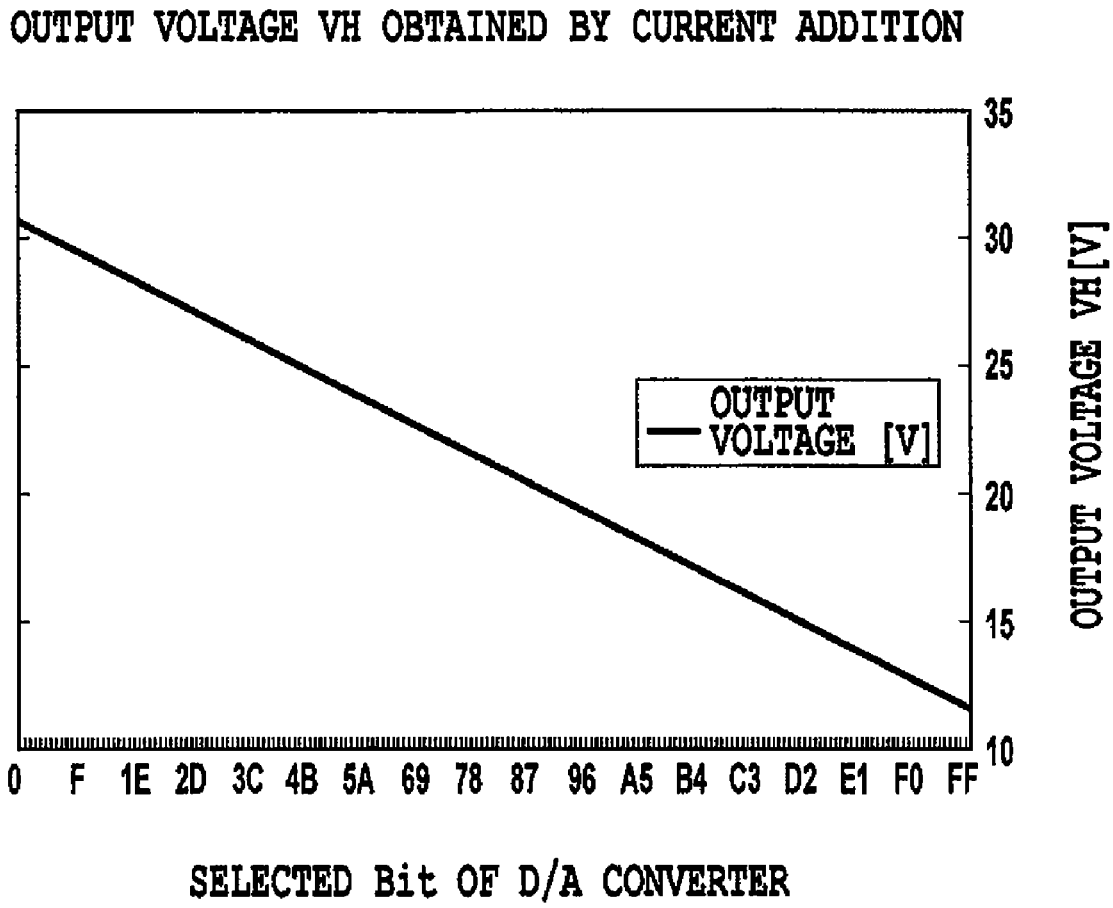
FIG. 15 is a diagram showing a relation between an input control signal C to a D/A converter and an output voltage VH.

FIG. 15 is a graph showing a relation between an input value of the control signal C to the D/A converter 16 and its output voltage VH. As can be seen from the above equations, in this case as the control signal C increases, the output voltage VH linearly decreases.

Next, the relation between a drive pulse and an ink ejection will be explained in detail for a case where the print head and the voltage modulation circuit of FIG. 13 and FIG. 14 are used. In the ink jet print head, to eject ink from individual nozzle openings requires imparting more than a predetermined amount of energy to each heater. The predetermined amount of energy is referred to as an energy threshold. The ejection will not occur unless the heater is given more than the energy threshold. When the heater is supplied energy by applying a pulse voltage to it, as in the print head of this embodiment, parameters that adjust the amount of energy include a pulse voltage value and a pulse width. In applying a predetermined amount of energy, the pulse voltage value and the pulse width have a relation in which increasing one of the two parameters results in the other becoming smaller.

As the pulse voltage value is changed with the pulse width kept at a fixed value P, a voltage Vth which is a threshold of whether ink is ejected or not and a voltage VOP at which stable ink ejection from all nozzles is ensured can be determined experimentally. Since there are variations in the state of heater surface of the print head, having a voltage just exceed Vth does not necessarily mean that stable ejection occurs from all nozzles. In the actual printing, therefore, it is general practice to apply a drive voltage VH based on the voltage VOP that ensures stable ejection from all nozzles. Here, the drive voltage VH can be expressed as $$VH=k\times Vth$$

In the above equation, k is expressed as a ratio of the drive voltage VH to the threshold voltage Vth with the pulse width P fixed. Generally, however, k is used as a parameter representing a ratio of drive energy to the energy threshold. In other words, keeping the k value constant means keeping the drive energy constant and it is therefore possible to use and adjust a relation between the drive voltage VH and the pulse width P by keeping the k value constant.

The k value is preferably set somewhat large in securing stable ejection. Continuing the application of too large an energy, however, could shorten the life of the heater. In general ink jet printing apparatus, therefore, the k value is adjusted to an appropriate value to ensure that stable ejection can be executed for as long a period as possible.

Changing the drive voltage VH and the pulse width P while holding them in a certain relationship can modulate an ejection volume under predetermined drive energy.

Figure 16:
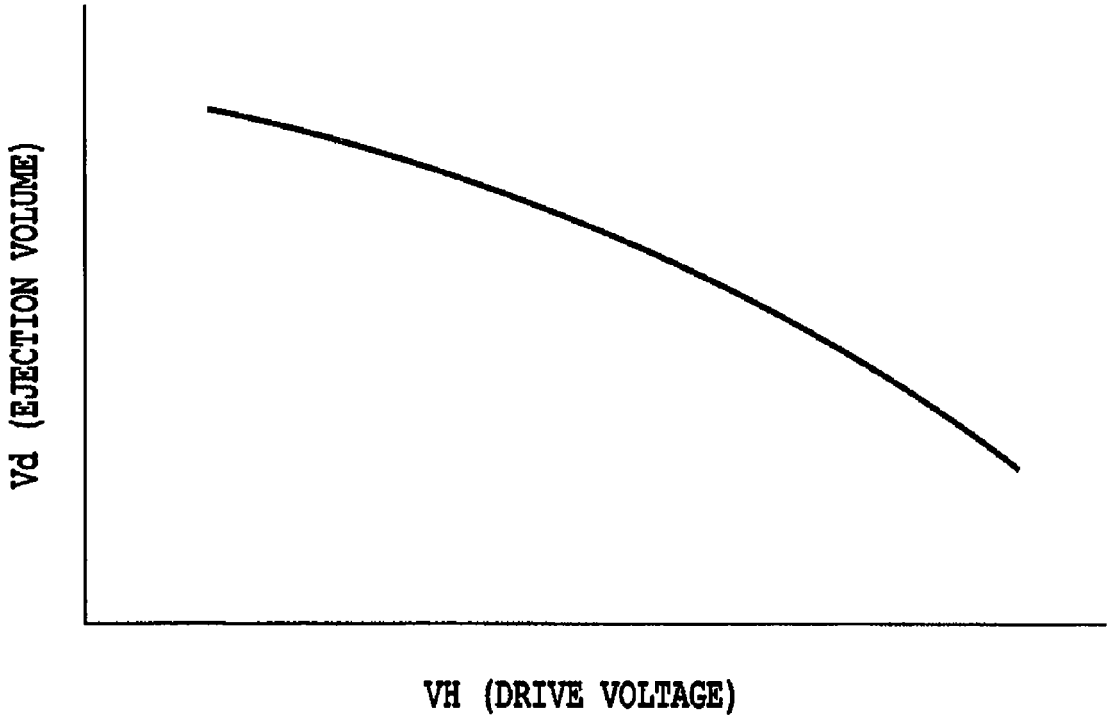
FIG. 16 illustrates how the ejection volume changes when the drive voltage is changed, with k kept constant.

FIG. 16 shows a change in the ejection volume Vd when the drive voltage VH to the heater is changed, with k fixed at 1.15. Referring to the diagram, the ejection volume decreases as the applied voltage increases. This is considered due to the fact that since the k value is constant, the pulse width decreases as the drive voltage VH increases. A shorter pulse width means a shorter time in which the heat of the heater can be transmitted to the ink and a smaller amount of ink that can be heated enough to contribute to the bubble generation.

Figure 17:
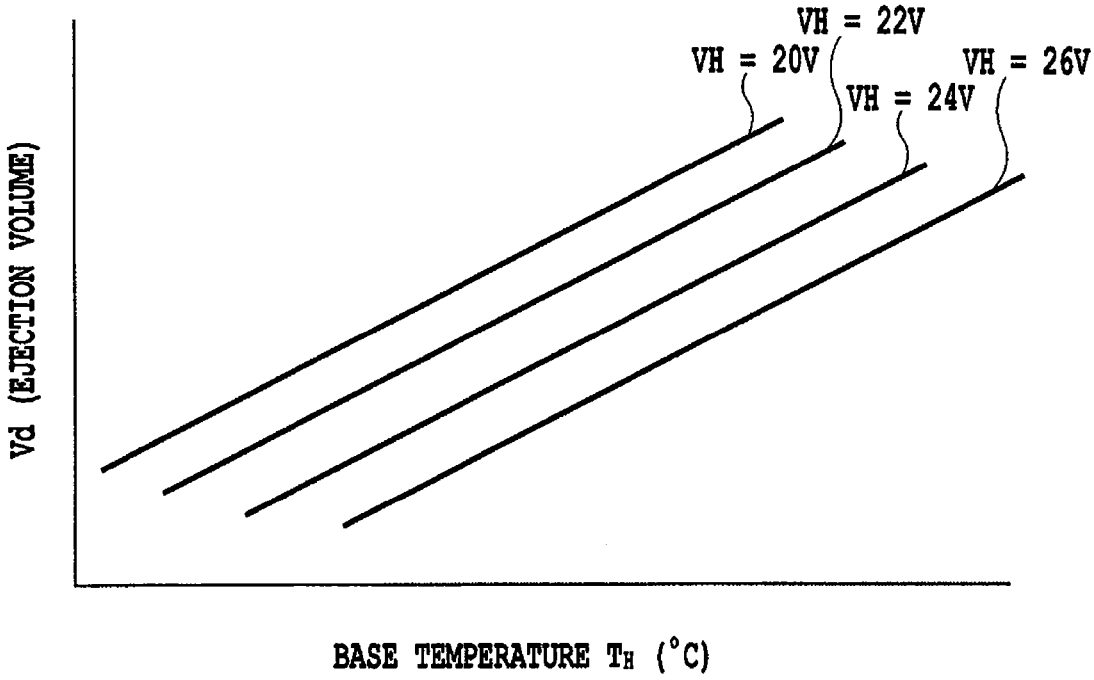
FIG. 17 is a graph showing a relation between a base temperature of the print head and an ejection volume.

FIG. 17 shows a relation between the temperature of the print head substrate (base temperature) and the ejection volume. As already explained with reference to FIG. 13, the substrate 24 is formed with heaters and flow paths. So, the temperature of this member (base temperature) can be deemed almost equal to the temperature of ink in the print head. The base temperature varies, influenced by a surrounding temperature of the print head and by a temperature increase of the print head resulting from repetitive printing operations. The diagram shows that the ejection volume increases almost linearly with the base temperature. Four characteristic lines are shown here for four different drive voltages VH, with the k value kept constant. As explained in FIG. 16, the ejection volume decreases as the drive voltage VH increases.

In a single pulse drive control, by taking advantage of the characteristics explained with reference to FIG. 16 and FIG. 17, the ejection volume that changes according to variations in the print head temperature and heater rank can be kept within a predetermined range.

Figure 18:
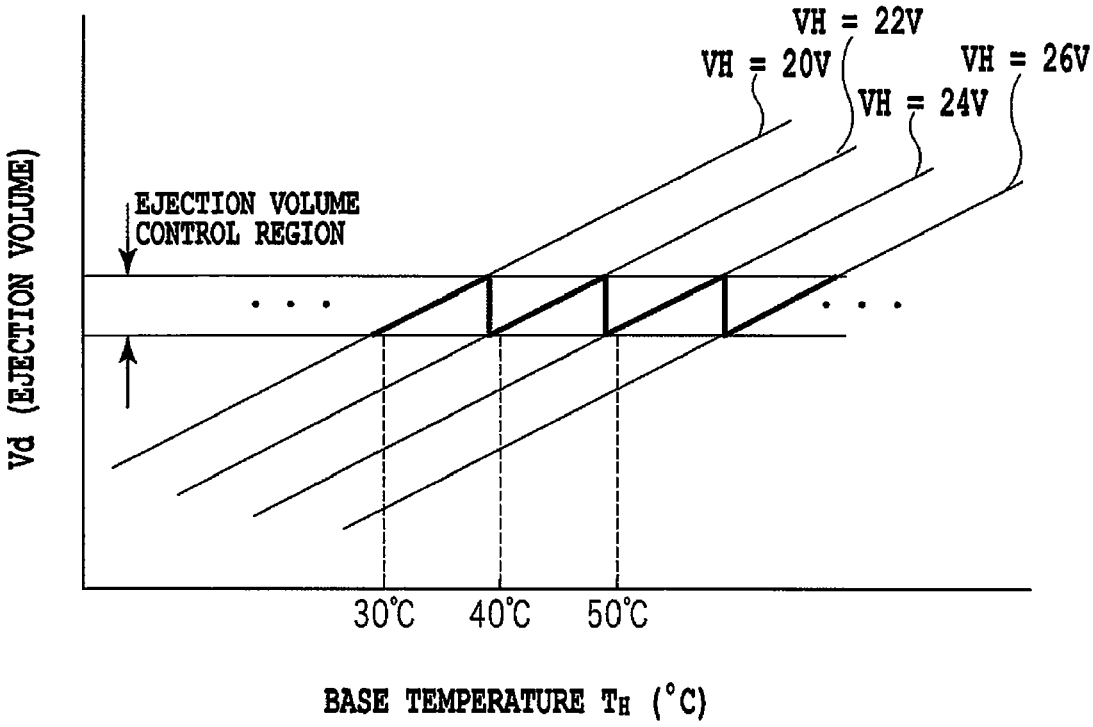
FIG. 18 is a graph showing a control method that keeps the ejection volume during printing within a predetermined range by switching the drive voltage according to the detected base temperature.

FIG. 18 shows a control method to keep the ejection volume during printing within a predetermined range by changing the drive voltage VH according to the detected base temperature. For example, when the base temperature is 30° C., to have the ejection volume fall within a target control range needs to set the drive voltage VH at 20 V. If the base temperature reaches 40° C. after continued printing, the ejection volume can be held within the control range by raising the drive voltage VH to 22 V. Further, if the base temperature detected increases to 50° C., the drive voltage VH needs to be raised to 24 V. The relation between the base temperature and the ejection volume in this control follows a locus indicated by a thick line in the diagram, showing that the ejection volume is kept within the control range at any base temperature. Since the k value is kept constant in any case, the pulse width P is set smaller as the drive voltage VH increases.

Figure 19:
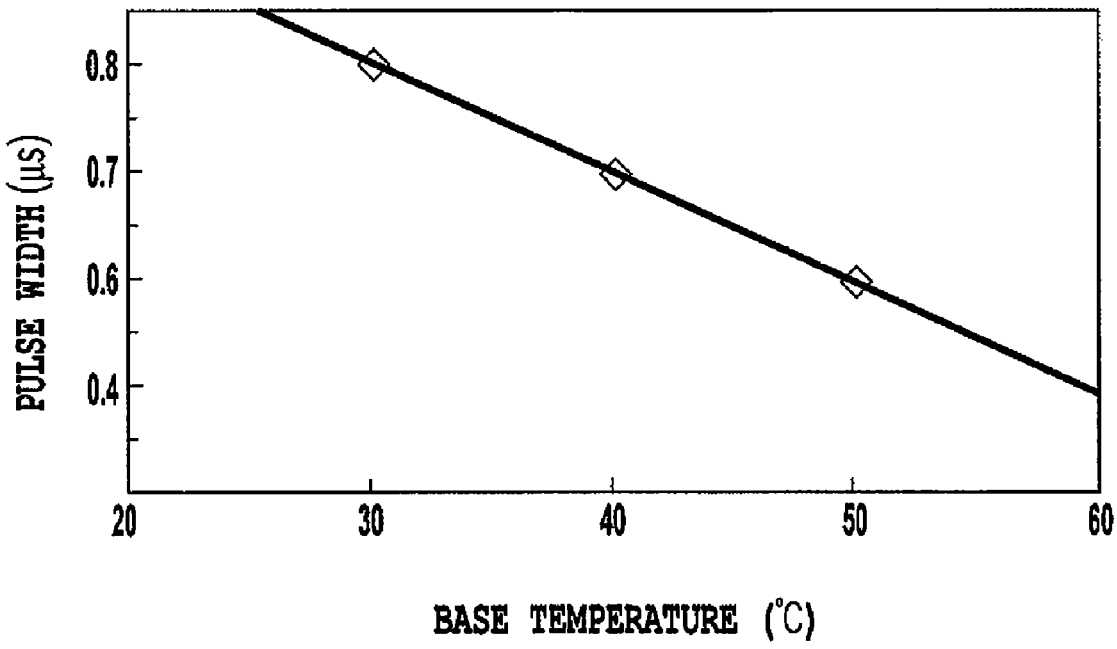
FIG. 19 is a graph showing a relation between the base temperature and a pulse width.

FIG. 19 illustrates a relation between the base temperature and the pulse width P set by the above method. From FIG. 18 and FIG. 19 combined, the relation may be explained as follows. A drive voltage of 20 V and a pulse width of 0.8 μs in this relation at a base temperature of 30° C. change to 22 V and 0.7 μs at 40° C. and to 24 V and 0.6 μs at 50° C.

The ejection volume of the print head depends not only on the base temperature and the drive voltage VH but also on a resistance (electrical characteristic) of the heaters arranged on the substrate and a composition of the ink. That is, if the base temperatures and the drive pulse waveforms are the same, different resistances and different ink characteristics (ease with which a bubble can be formed and thermal conductivity) can result in different ejection volumes and even different ejection/non-ejection commands. In this specification, a heat amount information representing the amount of heat transferred from the heater to the ink in unit time is hereinafter referred to as a heater rank. The heater rank is a relative level among a plurality of heaters. The heater rank may, for example, be a time it takes from application of a predetermined drive voltage to the heater until a bubble is formed. The heater rank is determined by a number of elements making up the print head. When the heater film thickness is made thin for a compact head, in particular, film thickness errors appear as variations in heater rank. Further, if the resistances are equal, the bubble formability and thermal conductivity may differ from one ink to another, resulting in different heater ranks.

In performing a control, such as explained with reference to FIG. 18, which keeps the ejection volumes of all nozzle columns in a specified range, it is preferred that a combination of the drive voltage VH and the base temperature be prepared for each heater rank. Such a control can be realized by preparing a table containing a drive pulse waveform for each heater rank and temperature, referencing the table during the printing operation and, based on the detected base temperature, setting appropriate drive voltage VH and pulse width P.

While the above description mainly concerns the ejection volume control when a single pulse drive control is employed, the ejection volume control based on the heater rank and base temperature can be executed using a double pulse drive control. The ejection volume control using the double pulse drive control will be briefly explained.

Figure 1:
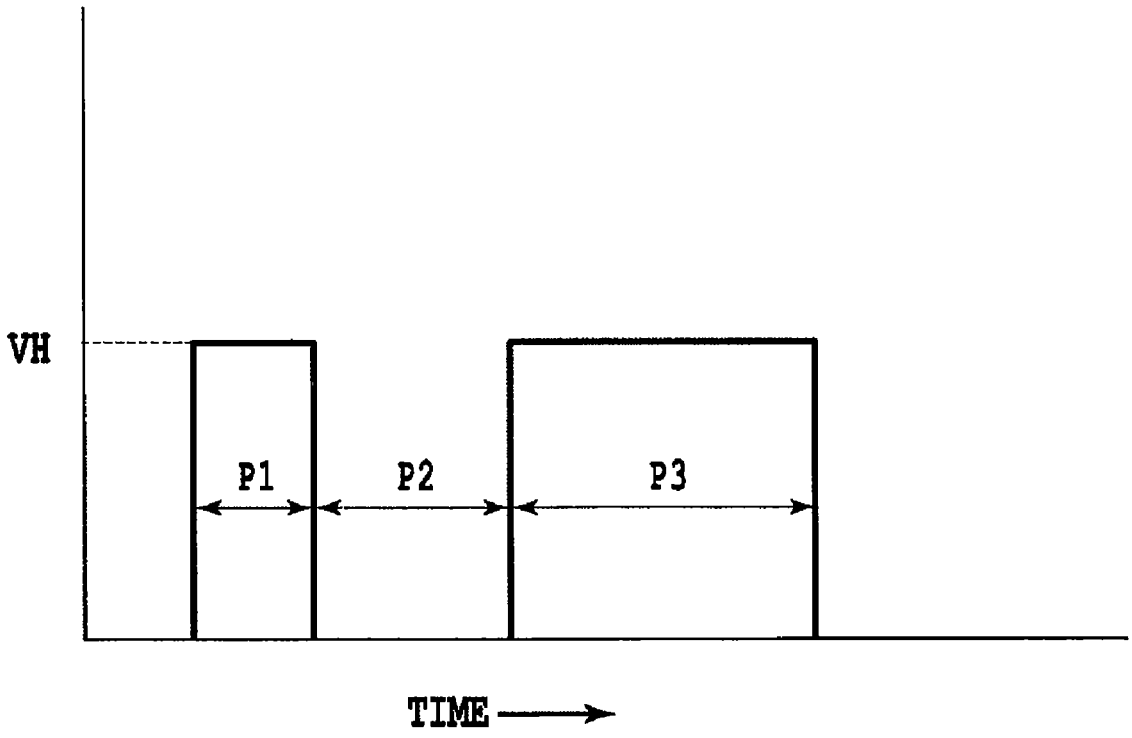
FIG. 1 is a timing chart showing a double pulse drive control.

As already explained, the double pulse drive control applies two pulses, such as shown in FIG. 1, to a heater for executing one ejection. Although the ejection is actually executed by a main heat pulse of a width P3, the ejection volume can be controlled by adjusting a pulse width P1 of a preheat pulse and an interval P2.

Figure 20:
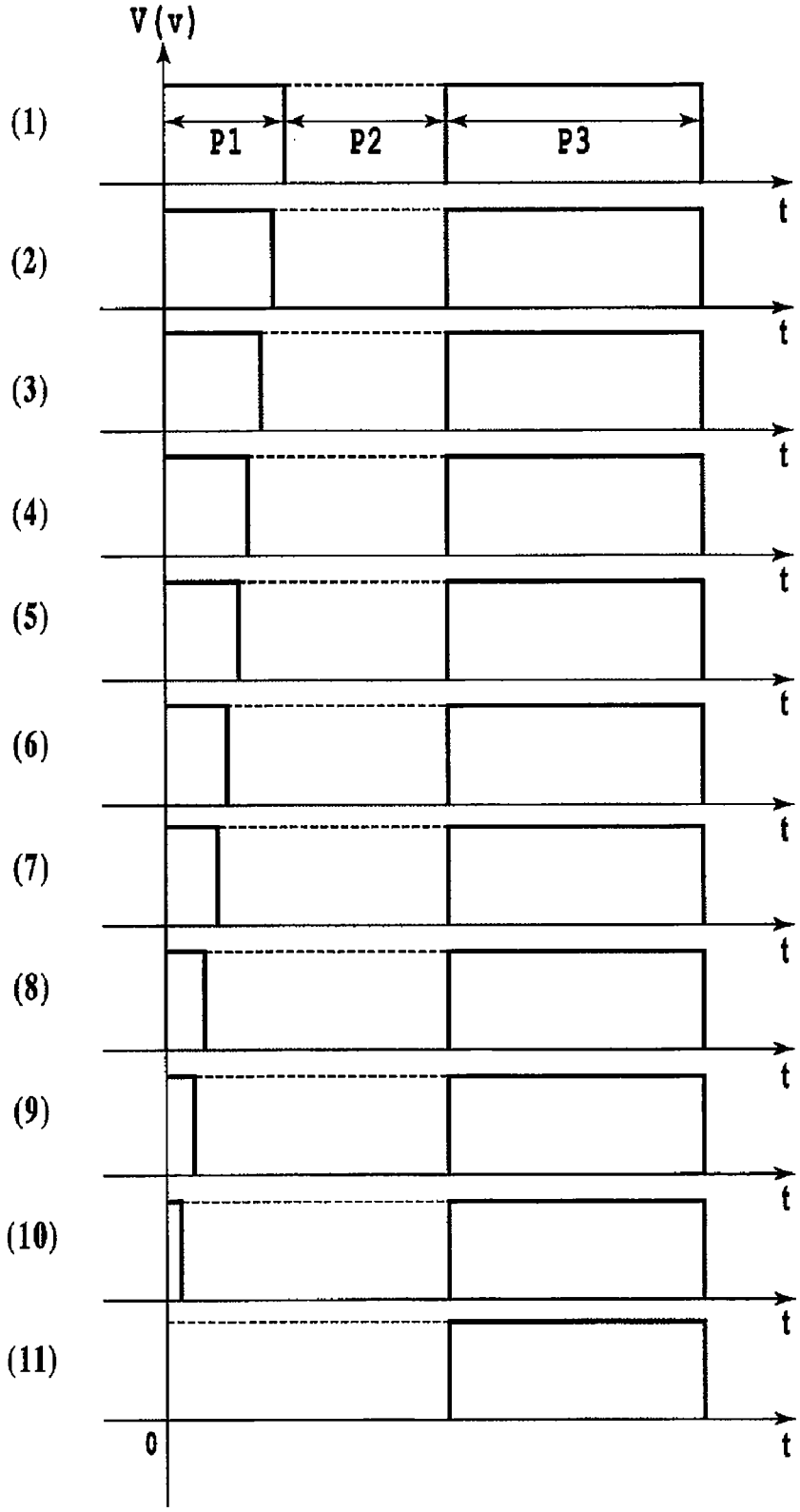
FIG. 20 illustrates pulses when a preheat pulse width and its interval are changed stepwise, with the main heat pulse kept constant.

FIG. 20 shows waveforms of a pulse signal when the preheat pulse width P1 and the interval P2 are changed stepwise, as shown at (1) to (11), with the main heat pulse width P3 fixed. (1) represents a case where the preheat pulse width P1 is largest and (11) represents a case where the preheat pulse width P1 is zero.

Figure 21:
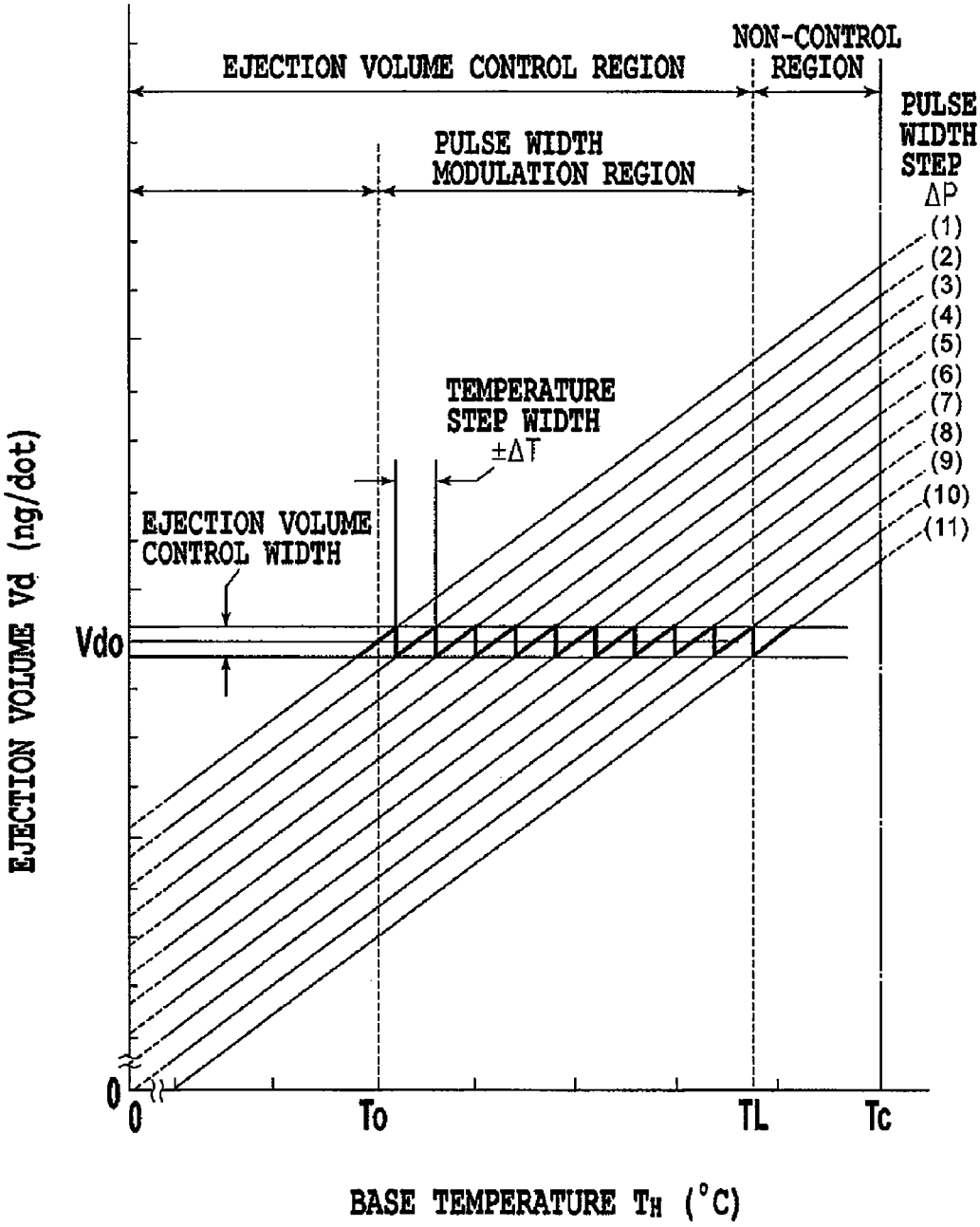
FIG. 21 is a graph showing a control method that keeps the ejection volume during printing within a predetermined range by changing the preheat pulse width according to a relation between the base temperature and the ejection volume and the detected base temperature.

FIG. 21 explains a relation between the base temperature and the ejection volume and a control method that keeps the ejection volume during printing within a specified range by changing the preheat pulse width according to the detected base temperature. In FIG. 21, the ejection volume increases almost linearly with the base temperature. This diagram also shows a plurality of results for each of the pulse waveforms shown at (1)-(11) of FIG. 20 and that the ejection volume increases with the preheat pulse width P1. That is, in the double pulse drive control, changing the pulses according to the detected base temperature in a way that describes a locus of thick line in the figure can keep the ejection volume within the control range at any base temperature.

Figure 22:
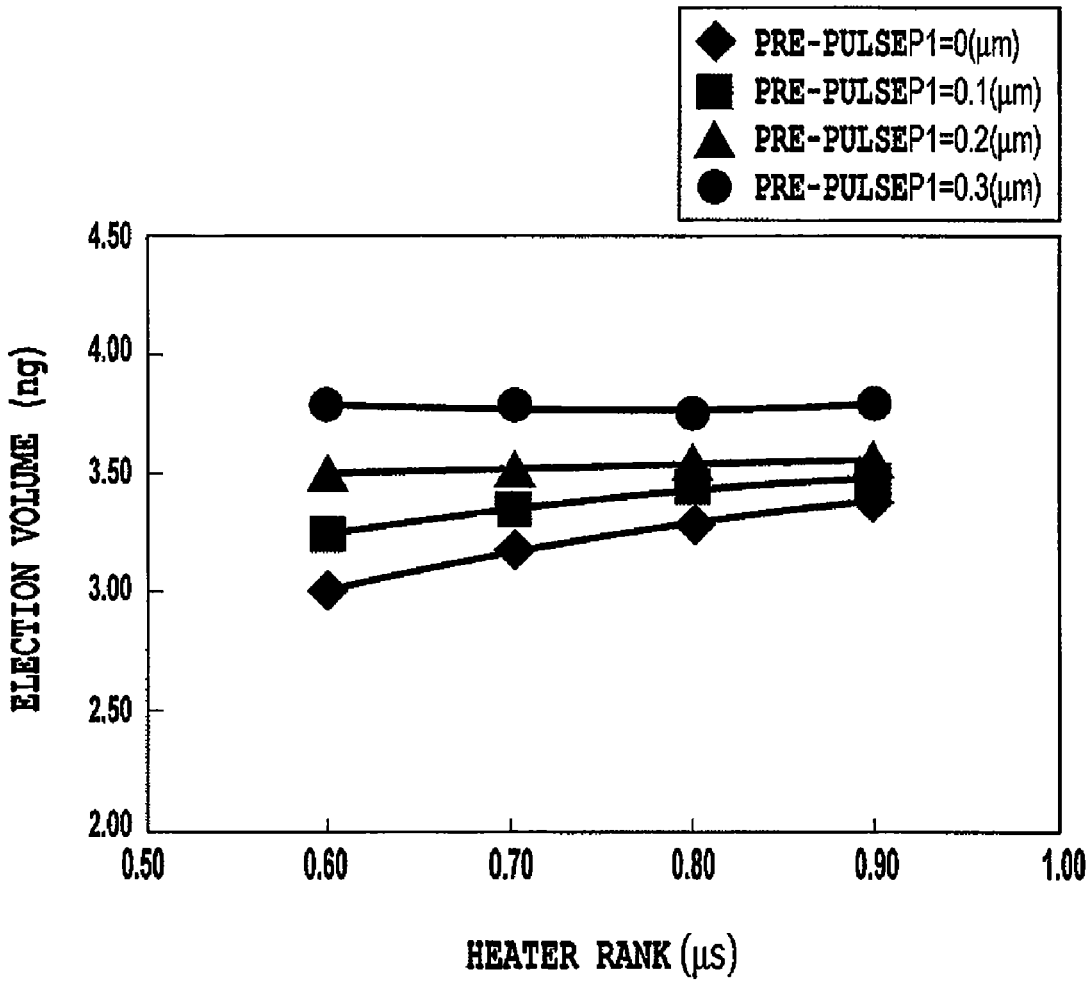
FIG. 22 is a diagram showing a relation between the heater rank and the ejection volume in the double pulse drive control for each preheat pulse width.

FIG. 22 shows the relation between the heater rank and the ejection volume in the double pulse drive control for each preheat pulse width P1. The heater rank on the abscissa represents a time it takes from when a specified drive voltage is applied to the heater until a bubble is formed. The diagram shows that, even with the same preheat pulse width. P1, the ejection volumes differ for different heater ranks. Further, even at the same heater rank, the ejection volume can be changed by changing the preheat pulse width P1. It is noted, however, that the rate of change differs from one heater rank to another. When the heater rank is relatively small, changing the preheat pulse width P1 can result in a large change in the ejection volume. When the heater rank is relatively large, the control range in which the ejection volume can be changed by the preheat pulse width P1 is small.

A heater with a small heater rank, when compared with a heater with a large heater rank, can transfer a greater amount of heat to the ink in a unit time. That is, a heater with a smaller heater rank has a greater heat flux. Therefore, even if the heater with a small heater rank is applied a preheat pulse of the same waveform as that applied to a heater with a large heater rank, it can increase the ink volume contributing to the bubble generation and influencing the ejection volume. It can therefore be said that a heater with a lower heater rank can produce a greater effect of the double pulse drive control.

In performing the double pulse drive control, it is preferable to set the heater drive voltage relatively low. This is because a lower drive voltage allows the heat flux to be set lower, making more detailed control on the ejection volume by the preheat pulse width possible. Generally, it can also be said that the double pulse drive control, which adjusts the preheat pulse application time with the drive voltage kept constant, has higher control reliability. However, as the size reduction of ink droplets progresses rapidly in recent years, it is increasingly difficult to stably maintain the small ejection volume with only the double pulse drive control. For example, consider a case where the print head temperature continues to rise as a result of continuous printing operation. To reduce the ejection volume, the width of the preheat pulse is narrowed. However, even when the pulse width is zero, the ejection volume may still remain too large.

Whether the double pulse drive control or single pulse drive control is employed, the ejection volumes of a plurality of nozzle columns can be held within a specified range as long as a construction is provided which sets an appropriate drive pulse based on the heater rank and the detected base temperature. This construction includes a table having drive pulse waveforms for various heater ranks and base temperatures and allows an appropriate drive pulse to be set according to the detected base temperature by referring to the table. The table preferably includes various characteristics associated with the drive controls described above so that, at normal base temperatures, the double pulse drive control is executed using a low drive voltage with a small heat flux and that, from when the preheat pulse width P1 becomes zero after the base temperature has risen, the drive control is switched to the single pulse drive control. This selective execution of the double pulse drive control and the single pulse drive control can be expected to eject small droplets of predetermined volume stably even if the temperature of the print head varies in a relatively wide range.

FIG. 23 shows a table providing drive pulses for 11 heater ranks at base temperatures of 20° C. to 50° C. For the sake of simplicity, the temperatures shown in the table are only 20° C., 30° C., 40° C. and 50° C. Here, a heater rank "min" refers to a heater that ejects the smallest volume of ink among the 11 heater ranks. Conversely, a heater rank "max" indicates a heater that ejects the greatest volume of ink. A heater rank "center" represents a roughly average heater rank. The "min" rank heater transfers a greater amount of heat to the ink per unit time than do the "center" and "max" rank heaters. For each combination of heater rank and base temperature, the preheat pulse width P1, main heat pulse width P3 and drive voltage VH are defined. In a region where the preheat pulse width P1 is zero, the single pulse drive control is performed.

Take a heater rank "max" for example. Up to the temperature of 30° C., the double pulse drive control is executed, with the drive voltage VH set to 20 V. However, when the base temperature reaches 30° C., the preheat pulse width is set to 0 and, at this timing, the control is switched to the single pulse drive control. That is, the drive pulse waveform is changed between a base temperature range of less than 30° C. and a base temperature range of more than and including 30° C. As the base temperature further rises, the drive voltage VH increases progressively and the main heat pulse width P3 becomes narrow. In the case of the heater rank "center", up to the base temperature of 40° C., the double pulse drive control is performed with the drive voltage set to 20 V. In the case of the "min" rank, up to the base temperature of 50° C., the double pulse drive control is executed with the drive voltage set to 20 V.

When the drive control is performed using the above table, a printing apparatus having a plurality of nozzle columns of different heater ranks requires different drive voltages to be supplied to different nozzle columns. For example, when the base temperature of 40° C. is detected, it is necessary to supply a drive voltage of 22 V to a nozzle column of "max" rank and a drive voltage of 20 V to a nozzle column of "min" rank.

As already explained, the printing apparatus of this embodiment provides a drive voltage VH that can be modulated in 256 steps by the circuit of FIG. 14. It should be noted, however, that only one drive voltage VH can be realized by this circuit at one time. Two or more voltages, such as 22 V and 20 V, cannot be provided simultaneously. That is, performing the control based on the table of FIG. 23 requires a plurality of head drive voltage modulation circuits (voltage adjust circuits) of FIG. 14 to be formed on the carriage printed circuit board E0013, making the circuit configuration of the printed circuit board complicated and large, increasing the cost of the printing apparatus itself.

Considering the above problem, the inventors of this invention have decided that it is effective to provide a table that can deal with all heater ranks with one drive voltage VH for the same base temperature by taking advantage of the features of both the double pulse drive control and the single pulse drive control.

FIG. 24 shows a pulse table applied to this embodiment. In this embodiment, a series of such pulse tables as described above are prepared first for the heater rank "max" in which, when a temperature of heater rises, the ejection volume control by the double pulse drive control becomes impossible at the earliest timing, i.e., at the lowest base temperature in a plurality of heater rank. That is, pulse information (waveforms) is defined for each temperature in the heater rank "max".

Then, the drive voltage VH for other heater ranks, the same as the drive voltage VH for the "max" rank, is set for each base temperature. That is, the table is generated so that the drive voltages are equal regardless of the heater ranks.

Further, the preheat pulse width P1 and the main heat pulse width P3 for each case are determined in a way that keeps the k value and the ejection volume constant throughout the table.

That is, for heater ranks other than the "max", the pulse widths are defined for each heater rank. Energy required to eject ink differs among different heater ranks. Therefore, in the same table, the pulse width differs among different heater ranks because the drive voltages are equal among different heater ranks.

The pulse width for other heater ranks than the "max" is set to allow the double pulse drive control to continue as practically as possible if the base temperature rises. As a result, after the heater rank "max" has switched to the single pulse drive control, the rate at which the preheat pulse width P1 decreases with respect to the base temperature increases. Then, when the preheat pulse can no longer be set for the drive voltage defined by the "max" heater rank, the control is switched to the single pulse drive control for the first time. The table shows that, while the drive voltages VH in the pulse information for the base temperature up to 30° C. are all set to 20 V, the drive voltages VH for the base temperature higher than 40° C. increase with the temperature, taking the same values in all heater ranks.

That is, at temperatures lower than a predetermined threshold (or in a temperature range lower than the threshold), the drive voltages VH are equal irrespective of the heater rank value. In a temperature range higher than the predetermined threshold, the drive voltage VH varies according to the temperature.

In the table of FIG. 24, as described above, the drive voltages VH are equal among different ranks at any base temperature, with only the preheat pulse width and the main heat pulse width of the pulse signal differing among the ranks. That is, even if the base temperature changes, the amplitudes of the pulse signal are equal among the ranks, with only the pulse widths differing among the ranks.

The temperatures shown in the tables of FIG. 23 and FIG. 24 are simplified examples for easy understanding and the temperature range may be set otherwise. For example, the table may comprise 5° C. temperature ranges.

For the drive control of the print head by referring to this table, the ASIC E1102 of FIG. 11 sets amplitude and a pulse width of the pulse signal. Based on the set amplitude, the head drive voltage modulation circuit modulates the drive voltage. Further based on the set pulse width, the ASIC E1102 outputs a head control signal.

Figure 2:
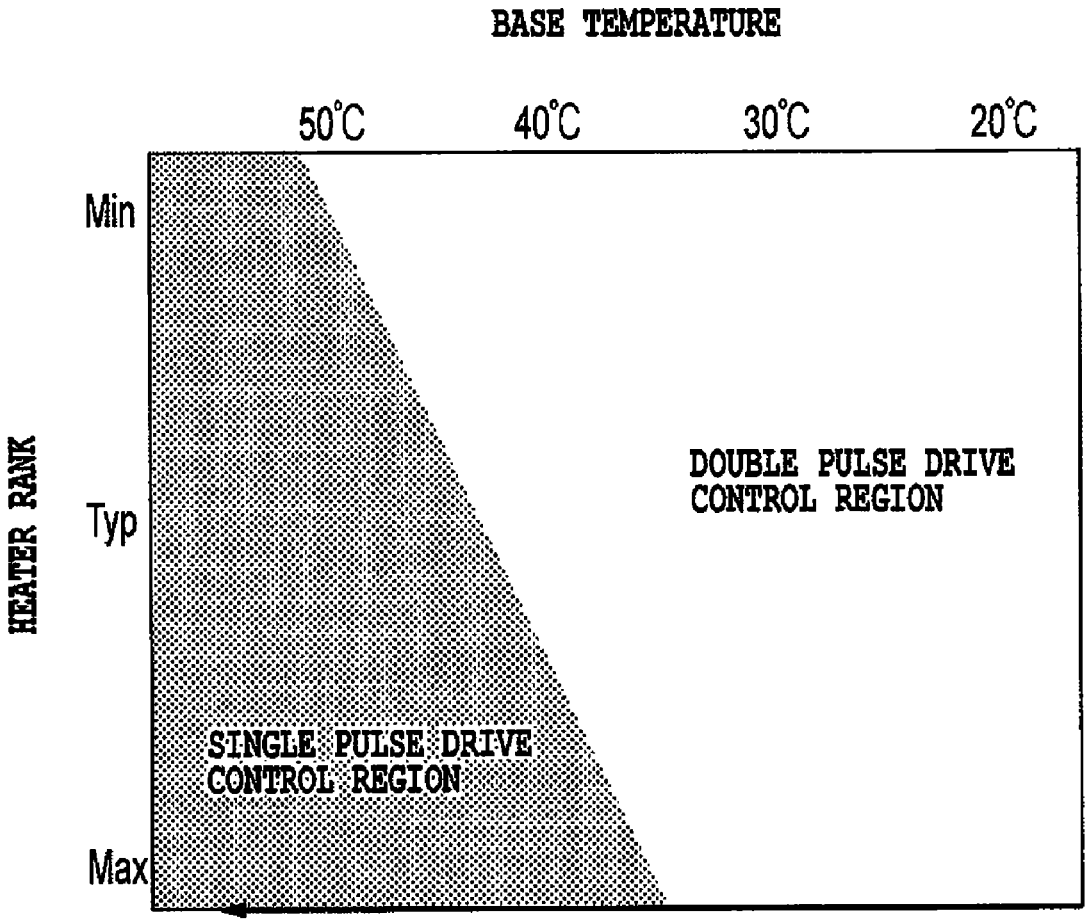
FIG. 2 is a schematic diagram showing how the drive control method is switched according to the heater rank and temperature of the print head.

FIG. 2 schematically shows timing for each heater rank at which to switch from the double pulse drive control to the single pulse drive control when the base temperature changes during the drive control using the table of FIG. 24. The abscissa represents a base temperature which increases toward left. The ordinate represents a heater rank. A shaded portion represents a region where the single pulse drive control is performed and a blank portion represents a region where the double pulse drive control is executed. Different heater ranks have different base temperatures at which the double pulse drive control is switched to the single pulse drive control. For example, the heater rank "max" switches from the double pulse drive control to the single pulse drive control at a lower temperature than does the heater rank "min". As the heater rank decreases, the range of the double pulse drive control increases.

The ink jet print head with a heater basically can perform the ejection volume control on nozzle columns of any heater rank either by the double pulse drive control or the single pulse drive control. This embodiment performs mainly the double pulse drive control that can lower heat flux and can control the ejection volume more precisely. This embodiment can also change the drive voltage VH for all heater ranks when the double pulse drive control becomes insufficient for some heater ranks. Such a pulse table is stored in a ROM in the printing apparatus and one head drive voltage modulation circuit is provided which produces a single drive voltage according to the base temperature. This construction can keep the ejection volume for all heater ranks within a specified control range over a wide range of base temperature, without requiring a complex circuit.

Other Embodiments

In the first embodiment, a table is generated which is based on the heater rank "max" in order to be able to deal with all of a plurality of heater ranks that can theoretically occur in the print head manufacturing process. However, the heater ranks from min to max do not necessarily exist in all of the manufactured print heads. In practice, different print heads have different combinations of heater ranks. In such a case, in a print head that does not have a heater rank "max", for example, there is no need to match the drive voltage VH of each heater rank to the table of "max" rank. What is required is to prepare a table based on the highest heater rank among the plurality of nozzle columns and set the drive voltage VH and pulse width for each base temperature according to the pulse table. This arrangement can widen the range of the double pulse drive control that is capable of precise control and which provides a wide range of ejection volume modulation for all nozzle columns in the print head.

This invention is not limited to the construction that determines the drive voltage to all nozzle columns so that it conforms to a higher heater rank. For example, if it is decided in the print head manufacturing process that there are far more heater ranks "center" than other heater ranks, a pulse table may be based on the heater rank "center". For other heater ranks, a pulse table may be prepared which conforms to a drive voltage of the "center" rank and still offers as uniform ejection volumes as possible.

In the above embodiments, the heater rank is determined for a nozzle column as a unit that ejects one and the same color ink, as shown at 25 in FIG. 13. The base temperature is notified from a temperature sensor not shown in the individual substrates 24 to the main printed circuit board. So, when there are a plurality of print heads or a plurality of substrates 24 are installed in the same print head, two or more pieces of base temperature information are notified to the main printed circuit board.

It should be noted that the above construction by no means limits the present invention. The heater rank may be determined for each substrate 24 as a unit or for one or more individual nozzles as a unit. Further, the temperature information used in setting a pulse need not be a temperature on the substrate 24. The ink temperature may be directly measured or may be estimated from a temperature of other portions on the print head than the substrate.

In the above embodiments, an example configuration has been explained which provides a constant drive voltage for a particular base temperature and which executes the double pulse drive control as practically as possible. It is noted, however, that this invention is not limited to this configuration. This invention can perform the ejection volume control for a particular drive voltage and a particular base temperature by using either the double pulse drive control or the single pulse drive control even if there are differences in precision and reliability between the two drive controls. Whichever base temperature or whichever drive control is used, the only requirement of this invention is to provide a pulse for each heater rank whose drive voltage is constant.

Further, in the above embodiments an example serial type ink jet printing apparatus has been explained which forms an image by repetitively alternating the main scan printing by the print head and the subscan feed of the print medium. This invention, however, is not limited to this printing apparatus. This invention can also be applied to an ink jet printing apparatus equipped with a full line type print head having a nozzle column equal in length to a print width of the print medium.

The heater rank may be defined as a parameter affecting the ejection volume of each nozzle column to change the ink ejection/non-ejection command and the ejection volume even if the base temperatures and the drive pulses are set equal.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-108068, filed Apr. 10, 2006, which is hereby incorporated by reference herein in its entirety.

What is claimed is:

1. An ink jet printing apparatus to form an image on a print medium by using a print head, wherein the print head has a first print element column and a second print element column, each composed of an array of print elements adapted to eject ink by applying a voltage pulse to a heater, the ink jet printing apparatus comprising:

means for acquiring for individual print element columns heat amount information representing the amount of heat transferred from the heater to the ink in unit time;

means for acquiring an ink temperature of the print element columns; and selection means for selecting a pulse for the individual print element columns based on the heat amount information and the ink temperature, wherein the selection means selects pulses of equal voltage values for the first print element column and the second print element column irrespective of the heat amount information, whatever value the ink temperature may be, and the voltage values of the selected pulses are based on the ink temperature, wherein the selection means selects a pulse based on a table having pulse information including a voltage value and a pulse width and also on the heat amount information and the ink temperature, wherein the table has a first temperature region and a second temperature region, and wherein the voltage value is constant in the first temperature region and differs depending on the ink temperature in the second temperature region.

2. An ink jet printing apparatus according to claim 1, wherein the pulses selected by the selection means for an arbitrary number of the print element columns are switched between double pulses formed of two pulses and a single pulse formed of one pulse according to the ink temperature.

3. An ink jet printing apparatus according to claim 1, further comprising a voltage modulation circuit capable of changing the voltage value based on the ink temperature.

4. An ink jet printing apparatus according to claim 1, wherein the first and second temperature regions each has pulse information corresponding to the heat amount information.

5. An ink jet printing apparatus according to claim 4, wherein the pulse width included in each of the pulse information of the table is based on a voltage value of the largest of a plurality of pieces of heat amount information in each temperature region and differs depending on the heat amount information.

6. An ink jet printing apparatus according to claim 1, wherein the table has the first temperature region corresponding to temperature lower than a predetermined temperature and the second temperature region corresponding to temperature higher than or equal to the predetermined temperature.

7. An ink jet printing apparatus according to claim 1, wherein the print head has a third print element column.

* * * * *